US009837085B2

(12) United States Patent
Kamano et al.

(10) Patent No.: US 9,837,085 B2
(45) Date of Patent: Dec. 5, 2017

(54) AUDIO ENCODING DEVICE AND AUDIO CODING METHOD

(71) Applicant: FUJITSU LIMITED, Kawasaki-shi, Kanagawa (JP)

(72) Inventors: Akira Kamano, Kawasaki (JP); Yohei Kishi, Kawasaki (JP); Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/483,414

(22) Filed: Sep. 11, 2014

(65) Prior Publication Data

US 2015/0149185 A1 May 28, 2015

(30) Foreign Application Priority Data

Nov. 22, 2013 (JP) ..... 2013-241522

(51) Int. Cl.
*G10L 19/00* (2013.01)
*G10L 19/008* (2013.01)
*G10L 19/02* (2013.01)

(52) U.S. Cl.
CPC ..... *G10L 19/008* (2013.01); *G10L 19/0212* (2013.01)

(58) Field of Classification Search
CPC ... G10L 19/00; G10L 19/0017; G10L 19/008; G10L 19/03; G10L 19/167
USPC ..... 704/500, 501, 503, 504
See application file for complete search history.

(56) References Cited

U.S. PATENT DOCUMENTS

| | | | | |
|---|---|---|---|---|
| 5,684,923 | A | 11/1997 | Suzuki et al. | |
| 2006/0153392 | A1 | 7/2006 | Kim et al. | |
| 2007/0127585 | A1 | 6/2007 | Suzuki et al. | |
| 2008/0219344 | A1 | 9/2008 | Suzuki et al. | |
| 2011/0046964 | A1* | 2/2011 | Moon | G10L 19/008 704/500 |
| 2012/0033817 | A1* | 2/2012 | Francois | G10L 19/008 381/2 |
| 2012/0078640 | A1* | 3/2012 | Shirakawa | G10L 19/0212 704/500 |

(Continued)

FOREIGN PATENT DOCUMENTS

| | | |
|---|---|---|
| EP | 2 618 330 A2 | 7/2013 |
| EP | 2 770 505 A1 | 8/2014 |
| JP | 6-149292 | 5/1994 |

(Continued)

OTHER PUBLICATIONS

Extended European Search Report dated Jun. 2, 2015 in corresponding European Patent Application No. 14184922.4.

(Continued)

*Primary Examiner* — Qi Han
(74) *Attorney, Agent, or Firm* — Staas & Halsey LLP

(57) ABSTRACT

An audio encoding device includes a processor; and a memory which stores a plurality of instructions, which when executed by the processor, cause the processor to execute: calculating a similarity in phase of a first channel signal and a second channel signal contained in a plurality of channels of an audio signal; and selecting, based on the similarity, a first output that outputs one of the first channel signal and the second channel signal, or a second output that outputs both of the first channel signal and the second channel signal.

10 Claims, 14 Drawing Sheets

(56) References Cited

U.S. PATENT DOCUMENTS

| | | | |
|---|---|---|---|
| 2012/0249785 | A1 | 10/2012 | Sudo et al. |
| 2013/0182854 | A1 | 7/2013 | Kishi et al. |

FOREIGN PATENT DOCUMENTS

| | | |
|---|---|---|
| JP | 2006-195471 | 7/2006 |
| JP | 2007-183528 | 7/2007 |
| JP | 2008-224902 | 9/2008 |
| JP | 2009-181137 | 8/2009 |
| JP | 2012-073351 | 4/2012 |
| JP | 2012-216998 | 11/2012 |
| JP | 2013-502608 | 1/2013 |
| JP | 2013-148682 | 8/2013 |
| WO | WO 2011/021845 A2 | 2/2011 |

OTHER PUBLICATIONS

Herre et al., "MPEG Surround—The ISO/MPEG Standard for Efficient and Compatible Multichannel Audio Coding", J. Audio Eng. Soc., vol. 56, No. 11, Nov. 1, 2008, pp. 932-955.

Japanese Office Action dated Jun. 27, 2017 in corresponding Japanese Patent Application No. 2013-241522 (4 pages) (3 pages English Translation).

Sperschneider, "ISO/IEC 13818-7:2005(E)—Coding of Moving Pictures and Audio", *International Organisation for Standardisation ISO/IEC JTC1/SC29/WG11*, Apr. 2005, pp. 1-181.

"ISO/IEC 14496-3:2005(E)", pp. 1-344, 2005.

"Information technology—MPEG audio technologies—Part 1: MPEG Surround", *International Standard ISO/IEC 23003-1 First Edition*, Feb. 2007, pp. 20-56, 125-126, and 250-260.

* cited by examiner

FIG. 2

| | | | | | | | | | | | | |
|---|---|---|---|---|---|---|---|---|---|---|---|---|
| idx | -20 | -19 | -18 | -17 | -16 | -15 | -14 | -13 | -12 | -11 | -10 | 201 |
| c [idx] | -2.0 | -1.9 | -1.8 | -1.7 | -1.6 | -1.5 | -1.4 | -1.3 | -1.2 | -1.1 | -1.0 | 202 |
| idx | -9 | -8 | -7 | -6 | -5 | -4 | -3 | -2 | -1 | 0 | 1 | 203 |
| c [idx] | -0.9 | -0.8 | -0.7 | -0.6 | -0.5 | -0.4 | -0.3 | -0.2 | -0.1 | 0.0 | 0.1 | 204 |
| idx | 2 | 3 | 4 | 5 | 6 | 7 | 8 | 9 | 10 | 11 | 12 | 205 |
| c [idx] | 0.2 | 0.3 | 0.4 | 0.5 | 0.6 | 0.7 | 0.8 | 0.9 | 1.0 | 1.1 | 1.2 | 206 |
| idx | 13 | 14 | 15 | 16 | 17 | 18 | 19 | 20 | 21 | 22 | 23 | 207 |
| c [idx] | 1.3 | 1.4 | 1.5 | 1.6 | 1.7 | 1.8 | 1.9 | 2.0 | 2.1 | 2.2 | 2.3 | 208 |
| idx | 24 | 25 | 26 | 27 | 28 | 29 | 30 | 209 | | | | |
| c [idx] | 2.4 | 2.5 | 2.6 | 2.7 | 2.8 | 2.9 | 3.0 | 210 | | | | |

200

FIG. 4

| idx | 0 | 1 | 2 | 3 | 4 | 5 | 6 | 7 |
|---|---|---|---|---|---|---|---|---|
| ICC[idx] | 1 | 0.937 | 0.84118 | 0.60092 | 0.36764 | 0 | -0.589 | -0.99 |

410

420

400

FIG. 5

| DIFFERENTIAL VALUE | idxicci |
|---|---|
| -7 | 11111111111111 |
| -6 | 11111111111110 |
| -5 | 111111111110 |
| -4 | 1111111110 |
| -3 | 1111110 |
| -2 | 11110 |
| -1 | 110 |
| 0 | 0 |

| DIFFERENTIAL VALUE | idxicci |
|---|---|
| 1 | 10 |
| 2 | 1110 |
| 3 | 111110 |
| 4 | 11111110 |
| 5 | 111111110 |
| 6 | 11111111110 |
| 7 | 1111111111110 |

500

FIG. 6

| | | | | | | | | | | | | |
|---|---|---|---|---|---|---|---|---|---|---|---|---|
| Idx | -15 | -14 | -13 | -12 | -11 | -10 | -9 | -8 | -7 | -6 | -5 | 610 |
| CLD[idx] | -150 | -45 | -40 | -35 | -30 | -25 | -22 | -19 | -16 | -13 | -10 | 620 |
| Idx | -4 | -3 | -2 | -1 | 0 | 1 | 2 | 3 | 4 | 5 | 6 | 630 |
| CLD[idx] | -8 | -6 | -4 | -2 | 0 | 2 | 4 | 6 | 8 | 10 | 13 | 640 |
| Idx | 7 | 8 | 9 | 10 | 11 | 12 | 13 | 14 | 15 | 650 | | |
| CLD[idx] | 16 | 19 | 22 | 25 | 30 | 35 | 40 | 45 | 150 | 660 | | |

600

FIG. 10

| SOUND SOURCE No. | FIRST OUTPUT RATIO (%) | REDUCED ENCODING AMOUNT |
|---|---|---|
| 1 | 38.9 | 17.6 |
| 2 | 16.7 | 7.5 |
| 3 | 97.6 | 44.2 |
| 4 | 52.4 | 23.7 |

AUDIO ENCODING DEVICE AND AUDIO CODING METHOD

CROSS-REFERENCE TO RELATED APPLICATION

This application is based upon and claims the benefit of priority from the prior Japanese Patent Application No. 2013-241522 filed on Nov. 22, 2013, the entire contents of which are incorporated herein by reference.

FIELD

Embodiments discussed herein are related to, for example, audio encoding devices, audio coding methods, audio coding programs, and audio decoding devices.

BACKGROUND

Audio signal coding methods of compressing the data amount of a multi-channel audio signal having three or more channels have been developed. As one of such coding methods, the MPEG Surround method standardized by Moving Picture Experts Group (MPEG) is known. Outline of the MPEG Surround method is disclosed, for example, in a MPEG Surround Specification: ISO/IEC23003-1. In the MPEG Surround method, for example, an audio signal of 5.1 channels (5.1 ch) to be encoded is subjected to time-frequency transformation, and a frequency signal thus obtained through time-frequency transformation is downmixed and thereby a three-channel frequency signal is generated once. Further, the three-channel frequency signal is downmixed again to calculate a frequency signal corresponding to a two-channel stereo signal. Then, the frequency signal corresponding to the stereo signal is encoded by the Advanced Audio Coding (MC) coding method, and the Spectral band replication (SBR) coding method. On the other hand, in the MPEG Surround method, when 5.1 channel signal is downmixed to produce a three-channel signal and the three channel signal is downmixed to produce a two channel signal, spatial information representing sound spread or localization is calculated and then encoded. In such a manner, the MPEG Surround method encodes a stereo signal generated by downmixing a multi-channel audio signal and spatial information having relatively less data amount. Thus, the MPEG Surround method provides compression efficiency higher than the efficiency obtained by independently coding signals of channels contained in the multi-channel audio signal.

In the MPEG Surround method, the three-channel frequency signal is encoded by dividing into a stereo frequency signal and two predictive coefficients (channel prediction coefficients) in order to reduce the amount of encoded information. The predictive coefficient is a coefficient for predictively coding a signal of one of three channels based on signals of other two channels. A plurality of predictive coefficients are stored in a table called the codebook, which is used for improving the efficiency of bits to be used. With an encoder and a decoder having a common predetermined codebook (or a codebook prepared in a common way), important information can be sent with less number of bits. When encoding, a predictive coefficient is selected from the codebook. When decoding, a signal of one of three channels is reproduced based on the selected predictive coefficient.

SUMMARY

In accordance with an aspect of the embodiments, an audio encoding device includes a processor; and a memory which stores a plurality of instructions, which when executed by the processor, cause the processor to execute: calculating a similarity in phase of a first channel signal and a second channel signal contained in a plurality of channels of an audio signal; and selecting, based on the similarity, a first output that outputs one of the first channel signal and the second channel signal, or a second output that outputs both of the first channel signal and the second channel signal.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 2 is a diagram illustrating an example of a quantization table (codebook) relative to a predictive coefficient.

FIG. 4 is a diagram illustrating an example of a quantization table relative to a similarity.

FIG. 5 is an example of a diagram illustrating the relationship between an index differential value and similarity code.

FIG. 6 is a diagram illustrating an example of a quantization table relative to an intensity difference.

FIG. 10 is a diagram illustrating the coding efficiency subjected to an audio coding according to Embodiment 1.

DESCRIPTION OF EMBODIMENTS

Hereinafter, embodiments of an audio encoding device, an audio coding method and an audio coding computer program as well as an audio decoding device are described in detail with reference to the accompanying drawings. Embodiments do not limit the disclosed art.

(Embodiment 1)

Figure 1:
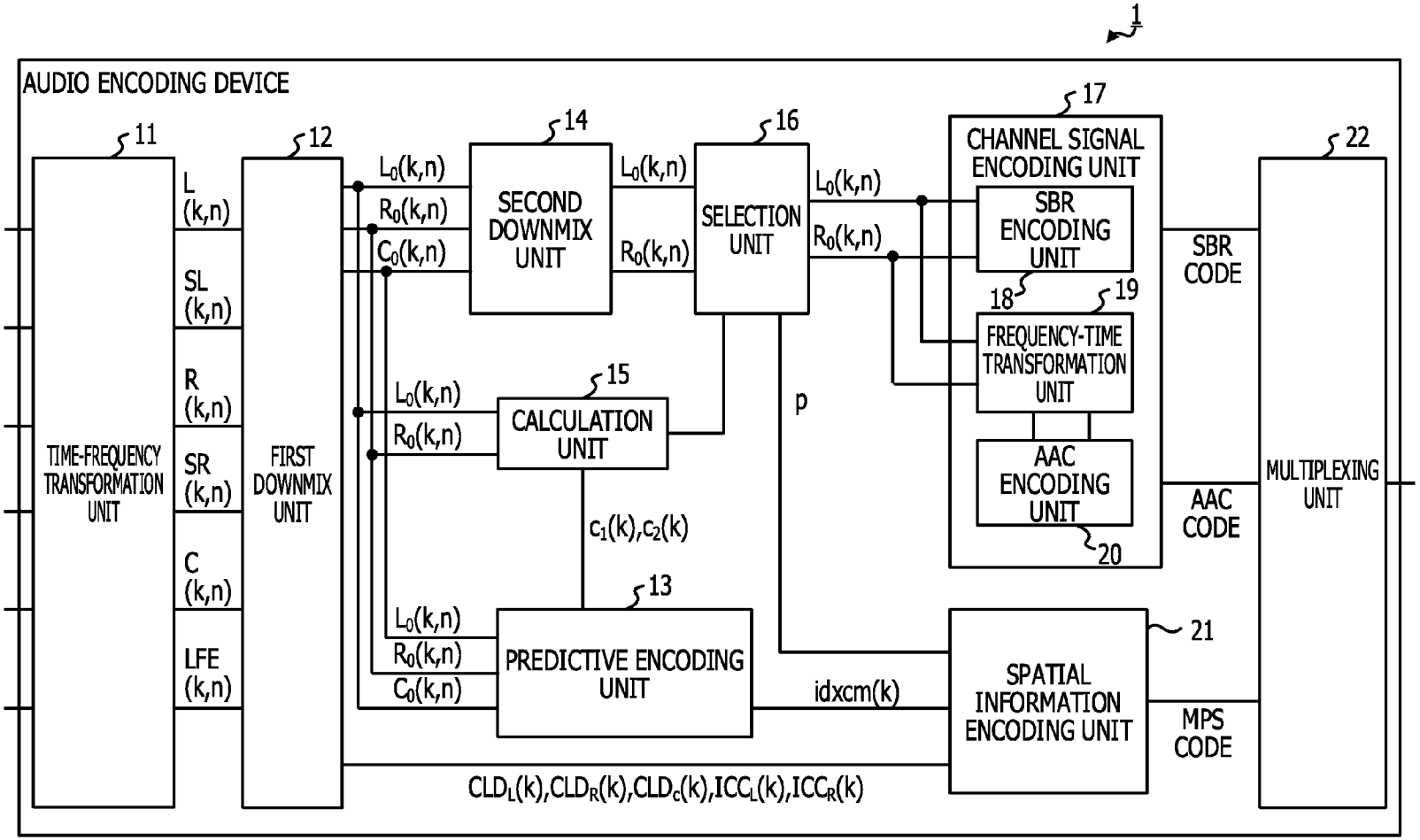
FIG. 1 is a functional block diagram of an audio encoding device according to one embodiment.

FIG. 1 is a functional block diagram of an audio encoding device 1 according to one embodiment. As illustrated in FIG. 1, the audio encoding device 1 includes a time-frequency transformation unit 11, a first downmix unit 12, a predictive encoding unit 13, a second downmix unit 14, a calculation unit 15, a selection unit 16, a channel signal encoding unit 17, a spatial information encoding unit 21, and a multiplexing unit 22.

Further, the channel signal encoding unit 17 includes a Spectral band replication (SBR) encoding unit 18, a frequency-time transformation unit 19, and an Advanced Audio Coding (MC) encoding unit 20.

Those components included in the audio encoding device 1 are formed as separate hardware circuits using wired logic, for example. Alternatively, those components included in the audio encoding device 1 may be implemented into the audio encoding device 1 as one integrated circuit in which circuits corresponding to respective components are integrated. The integrated circuit may be an integrated circuit such as, for example, an application specific integrated circuit (ASIC) and a field programmable gate array (FPGA). Further, these components included in the audio encoding device 1 may be function modules which are achieved by a computer program implemented on a processor included in the audio encoding device 1.

The time-frequency transformation unit 11 is configured to transform signals of the respective channels in the time domain of multi-channel audio signals entered to the audio encoding device 1 to frequency signals of the respective channels by time-frequency transformation on the frame by frame basis. In this embodiment, the time-frequency transformation unit 11 transforms signals of the respective channels to frequency signals by using a Quadrature Mirror Filter (QMF) filter bank of the following equation.

$$QMF(k, n) = \exp\left[j\frac{\pi}{128}(k+0.5)(2n+1)\right], \quad 0 \le k < 64,\ 0 \le n < 128 \qquad \text{(Equation 1)}$$

Here, "n" is a variable representing an nth time of the audio signal in one frame divided clockwise into 128 parts. The frame length may be, for example, any value between 10 and 80 msec. "k" is a variable representing a kth frequency band of the frequency signal divided into 64 parts. QMF(k,n) is QMF for providing a frequency signal having the time "n" and the frequency "k". The time-frequency transformation unit 11 generates a frequency signal of a channel by multiplying QMF (k,n) by an audio signal for one frame of the entered channel. The time-frequency transformation unit 11 may transform signals of the respective channels to frequency signals through another time-frequency transformation processing such as fast Fourier transform, discrete cosine transform, and modified discrete cosine transform.

Every time calculating the signals on the frame by frame basis, the time-frequency transformation unit 11 outputs frequency signals of the respective channels to the first downmix unit 12.

Every time receiving frequency signals from the time-frequency transformation unit 11, the first downmix unit 12 generates left-channel, center-channel and right-channel frequency signals by downmixing the frequency signals of the respective channels. For example, the first downmix unit 12 calculates frequency signals of the following three channels in accordance with the following equation.

$$L_{in}(k,n)=L_{inRe}(k,n)+j\cdot L_{inIm}(k,n)\ 0\le k<64, 0\le n<128$$

$$L_{inRe}(k,n)=L_{Re}(k,n)+SL_{Re}(k,n)$$

$$L_{inIm}(k,n)=L_{Im}(k,n)+SL_{Im}(k,n)$$

$$R_{in}(k,n)=R_{inRe}(k,n)+j\cdot R_{inIm}(k,n)\ 0\le k<64, 0\le n<128$$

$$R_{inRe}(k,n)=R_{Re}(k,n)+SR_{Re}(k,n)$$

$$R_{inIM}(k,n)=R_{Im}(k,n)+SR_{Im}(k,n)$$

$$C_{in}(k,n)=C_{inRe}(k,n)+j\cdot C_{inIm}(k,n)\ 0\le k<64, 0\le n<128$$

$$C_{inRe}(k,n)=C_{Re}(k,n)+LFE_{Re}(k,n)$$

$$C_{inIm}(k,n)=C_{Im}(k,n)+LFE_{Im}(k,n) \qquad \text{(Equation 2)}$$

Here, $L_{Re}(k,n)$ represents a real part of the left front channel frequency signal L(k,n), and $L_{Im}(k,n)$ represents an imaginary part of the left front channel frequency signal L(k,n). $SL_{Re}(k,n)$ represents a real part of the left rear channel frequency signal SL(k,n), and $SL_{Im}(k,n)$ represents an imaginary part of the left rear channel frequency signal SL(k,n). $L_{in}(k,n)$ is a left-channel frequency signal generated by downmixing. $L_{inRe}(k,n)$ represents a real part of the left-channel frequency signal, and $L_{inIm}(k,n)$ represents an imaginary part of the left-channel frequency signal.

Similarly, $R_{Re}(k,n)$ represents a real part of the right front channel frequency signal R(k,n), and $R_{Im}(k,n)$ represents an imaginary part of the right front channel frequency signal R(k,n). $S_{RRe}(k,n)$ represents a real part of the right rear channel frequency signal SR(k,n), and $SR_{Im}(k,n)$ represents an imaginary part of the right rear channel frequency signal SR(k,n). $R_{in}(k,n)$ is a right-channel frequency signal generated by downmixing. $R_{inRe}(k,n)$ represents a real part of the right-channel frequency signal, and $R_{inIm}(k,n)$ represents an imaginary part of the right-channel frequency signal.

Further, $C_{Re}(k,n)$ represents a real part of the center-channel frequency signal C(k,n), and $C_{Im}(k,n)$ represents an imaginary part of the center-channel frequency signal C(k,n). $LFE_{Re}(k,n)$ represents a real part of the deep bass sound channel frequency signal LFE(k,n), and $LFE_{Im}(k,n)$ represents an imaginary part of the deep bass sound channel frequency signal LFE(k,n). $C_{in}(k,n)$ is a center-channel frequency signal generated by downmixing. Further, $C_{inRe}(k,n)$ represents a real part of the center-channel frequency signal $C_{in}(k,n)$, and $C_{inIm}(k,n)$ represents an imaginary part of the center-channel frequency signal $C_{in}(k,n)$.

The first downmix unit 12 calculates, on the frequency band basis, an intensity difference between frequency signals of two downmixed channels, and a similarity between the frequency signals, as spatial information between the frequency signals. The intensity difference is information representing the sound localization, and the similarity becomes information representing the sound spread. The spatial information calculated by the first downmix unit 12 is an example of three-channel spatial information. In this embodiment, the first downmix unit 12 calculates an intensity difference $CLD_L(k)$ and a similarity $ICC_L(k)$ in a frequency band k of the left channel in accordance with the following equations.

$$CLD_L(k) = 10\log_{10}\left(\frac{e_L(k)}{e_{SL}(k)}\right) \quad \text{(Equation 3)}$$

$$ICC_L(k) = \mathrm{Re}\left\{\frac{e_{LSL}(k)}{\sqrt{e_L(k)\cdot e_{SL}(k)}}\right\} \quad \text{(Equation 4)}$$

$$e_L(k) = \sum_{n=0}^{N-1} |L(k,n)|^2$$

$$e_{SL}(k) = \sum_{n=0}^{N-1} |SL(k,n)|^2$$

$$e_{LSL}(k) = \sum_{n=0}^{N-1} L(k,n)\cdot SL(k,n)$$

Here, "N" represents the number of clockwise samples contained in one frame. In this embodiment, "N" is 128. $e_L(k)$ represents an autocorrelation value of the left front channel frequency signal L(k,n), and $e_{SL}(k)$ is an autocorrelation value of the left rear channel frequency signal SL(k,n). $e_{LSL}(k)$ represents a cross-correlation value between the left front channel frequency signal L(k,n) and the left rear channel frequency signal SL(k,n).

Similarly, the first downmix unit 12 calculates an intensity difference $CLD_R(k)$ and a similarity $ICC_R(k)$ of a frequency band k of the right-channel in accordance with the following equations.

$$CLD_R(k) = 10\log_{10}\left(\frac{e_R(k)}{e_{SR}(k)}\right) \quad \text{(Equation 5)}$$

$$ICC_R(k) = \mathrm{Re}\left\{\frac{e_{RSR}(k)}{\sqrt{e_R(k)\cdot e_{SR}(k)}}\right\} \quad \text{(Equation 6)}$$

$$e_R(k) = \sum_{n=0}^{N-1} |R(k,n)|^2$$

$$e_{SR}(k) = \sum_{n=0}^{N-1} |SR(k,n)|^2$$

$$e_{RSR}(k) = \sum_{n=0}^{N-1} L(k,n)\cdot SR(k,n)$$

Here, $e_R(k)$ represents an autocorrelation value of the right front channel frequency signal R(k,n), and $e_{SR}(k)$ is an autocorrelation value of the right rear channel frequency signal SR(k,n). $e_{RSR}(k)$ represents a cross-correlation value between the right front channel frequency signal R(k,n) and the right rear channel frequency signal SR(k,n).

Further, the first downmix unit 12 calculates an intensity difference $CLD_c(k)$ in a frequency band k of the center-channel in accordance with the following equation.

$$CLD_C(k) = 10\log_{10}\left(\frac{e_C(k)}{e_{LFE}(k)}\right) \quad \text{(Equation 7)}$$

$$e_C(k) = \sum_{n=0}^{N-1} |C(k,n)|^2$$

$$e_{LFE}(k) = \sum_{n=0}^{N-1} |LFE(k,n)|^2$$

Here, $e_C(k)$ represents an autocorrelation value of the center-channel frequency signal C(k,n), and $e_{LFE}(k)$ is an autocorrelation value of deep bass sound channel frequency signal LFE(k,n).

The first downmix unit 12 generates the three channel frequency signal and then further generates a left frequency signal in the stereo frequency signal by downmixing the left-channel frequency signal and the center-channel frequency signal. The second downmix unit 14 generates a right frequency signal in the stereo frequency signal by downmixing the right-channel frequency signal and the center-channel frequency signal. The first downmix unit 12 generates, for example, a left frequency signal $L_0(k,n)$ and a right frequency signal $R_0(k,n)$ in the stereo frequency signal in accordance with the following equation. Further, the first downmix unit 12 calculates, for example, a center-channel signal $C_0(k,n)$ utilized for selecting a predictive coefficient contained in the codebook.

$$\begin{pmatrix} L_0(k,n) \\ R_0(k,n) \\ C_0(k,n) \end{pmatrix} = \begin{pmatrix} 1 & 0 & \frac{\sqrt{2}}{2} \\ 0 & 1 & \frac{\sqrt{2}}{2} \\ 1 & 1 & -\frac{\sqrt{2}}{2} \end{pmatrix} \begin{pmatrix} L_{in}(k,n) \\ R_{in}(k,n) \\ C_{in}(k,n) \end{pmatrix} \quad \text{(Equation 8)}$$

Here, $L_{in}(k,n)$, $R_{in}(k,n)$, and $C_{in}(k,n)$ are respectively left-channel, right-channel, and center-channel frequency signals generated by the first downmix unit 12. The left frequency signal $L_0(k,n)$ is a synthesis of the left front channel, left rear channel, center-channel, and deep bass sound frequency signals of the original multi-channel audio signal. Similarly, the right frequency signal $R_0(k,n)$ is a synthesis of the right front channel, right rear channel, center-channel and deep bass sound frequency signals of the original multi-channel audio signal.

The first downmix unit 12 outputs the left frequency signal $L_0(k,n)$, the right frequency signal $R_0(k,n)$, and the center-channel signal $C_0(k,n)$ to the predictive encoding unit 13 and the second downmix unit 14. The first downmix unit 12 outputs the left frequency signal $L_0(k,n)$ and the right frequency signal $R_0(k,n)$ to the calculation unit 15. Further, the first downmix unit 12 outputs intensity differences $CLD_L(k)$, $CLD_R(k)$ and $CLD_R(k)$ and similarities $ICC_R(k)$ and $ICC_R(k)$, both serving as spatial information, to the spatial information encoding unit 21. The left frequency signal $L_o(k,n)$ and the right frequency signal $R_o(k,n)$ in Equation 8 may be expanded as follows:

$$L_0(k,n) = \left(L_{in\ Re}(k,n) + \frac{\sqrt{2}}{2}C_{in\ Re}(k,n)\right) + \left(L_{in\ Im}(k,n) + \frac{\sqrt{2}}{2}C_{in\ Im}(k,n)\right) \quad \text{(Equation 9)}$$

$$R_0(k,n) = \left(R_{in\ Re}(k,n) + \frac{\sqrt{2}}{2}C_{in\ Re}(k,n)\right) + \left(R_{in\ Im}(k,n) + \frac{\sqrt{2}}{2}C_{in\ Im}(k,n)\right)$$

The second downmix unit 14 receives the left frequency signal $L_0(k,n)$, the right frequency signal $R_0(k,n)$, and the center-channel signal $C_0(k,n)$ from the first downmix unit 12. The second downmix unit 14 downmixes two frequency signals out of the left frequency signal $L_0(k,n)$, the right frequency signal $R_0(k,n)$, and the center-channel signal $C_0(k,n)$ received from the first downmix unit 12 to generate a stereo frequency signal of two channels. For example, the stereo frequency signal of two channels is generated from the left frequency signal $L_0(k,n)$ and the right frequency signal $R_0(k,n)$. Then, the second downmix unit 14 outputs the stereo frequency signal to the selection unit 16.

The predictive encoding unit 13 receives the left frequency signal $L_0(k,n)$, the right frequency signal $R_0(k,n)$, and the central frequency signal $C_0(k,n)$ from the first downmix unit 12. The predictive encoding unit 13 selects predictive coefficients from the codebook for frequency signals of two channels downmixed by the second downmix unit 14. For example, when performing predictive coding of the center-channel signal $C_0(k,n)$ from the left frequency signal $L_0(k,n)$ and the right frequency signal $R_0(k,n)$, the second downmix unit 14 generates a two-channel stereo frequency signal by downmixing the right frequency signal $R_o(k,n)$ and the left frequency signal $L_0(k,n)$. When performing predictive coding, the predictive encoding unit 13 selects, from the codebook, predictive coefficients $c_1(k)$ and $c_2(k)$ such that an error d(k,n) between a frequency signal before predictive coding and a frequency signal after predictive coding becomes minimum (or a value less than any predetermined second threshold, which may be 0.5), the error being defined on the frequency band basis in the following equations with $C_0(k,n)$, $L_0(k,n)$, and $R_0(k,n)$. In such a manner, the predictive encoding unit 13 performs predictive coding of the center-channel signal $C'_0(k,n)$ subjected to predictive coding.

$$d(k,n) = \sum_k \sum_n \{|C_0(k,n) - C'_0(k,n)|^2\} \quad \text{(Equation 10)}$$

$$C'_0(k,n) = c_1(k) \cdot L_0(k,n) + c_2(k) \cdot R_0(k,n)$$

Equation 10 may be expressed as follows by using real and imaginary parts.

$$C'_0(k,n)=C'_{oRe}(k,n)+C'_{0Im}(k,n)$$

$$[[C'_{0Re}(k,n)=c_1\times L_{0Re}(k,n)+c_2\times R_{0Re}(k,n)]]$$

$$[[C'_{0Im}(k,n)=c_1\times L_{0Im}(k,n)+c_2\times R_{0Im}(k,n)]]$$

$$C'_{0Re}(k,n)=C_1(k)\times L_{0Re}(k,n)+C_2(k)\times R_{0Re}(k,n)$$

$$C'_{0Im}(k,n)=c_1(k)\times L_{0Im}(k,n)+c_2(k)\times R_{0Im}(k,n) \quad \text{(Equation 11)}$$

$L_{0Re}(k,n)$, $L_{0Im}(k,n)$, $R_{0Re}(k,n)$, and $R_{0Re}(k,n)$ represent a real part of $L_0(k,n)$, an imaginary part of $L_0(k,n)$, a real part of $R_0(k,n)$, and an imaginary part of $R_0(k,n)$ respectively.

As described above, the predictive encoding unit 13 can perform predictive coding of the center-channel signal $C_0(k,n)$ by selecting, from the codebook, predictive coefficients $c_1(k)$ and $c_2(k)$ such that the error d(k,n) between a center-channel frequency signal $C'_0(k,n)$ before predictive coding and a center-channel frequency signal $C'_0(k,n)$ after predictive coding becomes minimum. Equation 10 represents this concept in the form of the equation.

By using predictive coefficients $c_1(k)$ and $c_2(k)$ contained in the codebook, the predictive encoding unit 13 refers to a quantization table (codebook) illustrating a correspondence relationship between representative values of predictive coefficients $c_1(k)$ and $c_2(k)$ held by the predictive encoding unit 13, and index values. Then, the predictive encoding unit 13 determines index values most close to predictive coefficients $c_1(k)$ and $c_2(k)$ for respective frequency bands by referring to the quantization table. Here, a specific example is described. FIG. 2 is a diagram illustrating an example of the quantization table (codebook) relative to the predictive coefficient. In the quantization table 200 illustrated in FIG. 2, fields in rows 201, 203, 205, 207 and 209 represent index values. On the other hand, fields in rows 202, 204, 206, and 208 respectively represent representative values corresponding to index values in fields of rows 201, 203, 205, 207, and 209 in same rows. For example, when the predictive coefficient $c_1(k)$ relative to the frequency band k is 1.2, the second downmix unit 13 sets the index value relative to the predictive coefficient $c_1(k)$ to 12.

Next, the predictive encoding unit 13 determines a differential value between indexes in the frequency direction for frequency bands. For example, when an index value relative to a frequency band k is 2 and an index value relative to a frequency band (k−1) is 4, the predictive encoding unit 13 determines that the differential value of the index relative to the frequency band k is −2.

The predictive encoding unit 13 refers to, for example, the a-coding table 200 illustrating a correspondence relationship between the index-to-index differential value and the predictive coefficient code. Then, the predictive encoding unit 13 determines a predictive coefficient code index $idxc_m(k)$ (m=1,2 or m=1) of the predictive coefficient $c_m(k)$(m=1,2 or m=1) relative to a differential value of frequency bands k by referring to the coding table 200. Like the similarity code, the predictive coefficient code can be a variable length code having a shorter code length for a differential value of higher appearance frequency, such as, for example, the Huffman coding or the arithmetic coding. The quantization table and the coding table are stored in advance in an unillustrated memory in the predictive encoding unit 13. In FIG. 1, the predictive encoding unit 13 outputs the predictive coefficient code $idxc_m(k)$(m=1,2) to the spatial information encoding unit 21.

In the above method for selecting the predictive coefficient from the codebook, a plurality of predictive coefficients $c_1(k)$ and $c_2(k)$ may be included in the codebook such that an error d(k,n) between a frequency signal yet subjected to the predictive coding and a frequency signal subjected to the predictive coding becomes minimum (or less than any predetermined second threshold), for example, as disclosed in Japanese Laid-open Patent Publication No. 2013-148682). In this case, the predictive encoding unit 13 outputs any number of sets of predictive coefficients $c_1(k)$ and $c_2(k)$, and as appropriate, the number of predictive coefficients $c_1(k)$ and $c_2(k)$ with which the error d(k,n) becomes minimum (or, less than any predetermined second threshold).

The calculation unit 15 receives the left frequency signal $L_0(k,n)$ and the right frequency signal $R_0(k,n)$ from the first downmix unit 12. The calculation unit 15 also receives the number of predictive coefficients $c_1(k)$ and $c_2(k)$ with which the error d(k,n) becomes minimum (or, less than any predetermined second threshold), from the predictive encoding unit 13, as appropriate. The calculation unit 15 calculates a similarity in phase between the first channel signal and the second channel signal contained in a plurality of channels of the audio signal, as a first calculation method of the similarity in phase. Specifically, the calculation unit 15 calculates a similarity in phase between the left frequency signal $L_0(k,n)$ and the right frequency signal $R_0(k,n)$. The calculation unit 15 also calculates a similarity in phase based on the number of predictive coefficients with which an error in the predictive coding of a third channel signal contained in a plurality of channels of the audio signal becomes less than the above second threshold, as a second calculation method of the similarity in phase. Specifically, the calculation unit 15 calculates the similarity based on the number of predictive coefficients $c_1(k)$ and $c_2(k)$ received from the predictive encoding unit 13. The third channel signal corresponds to, for example, the center-channel signal $C_0(k,n)$. Hereinafter, the first calculation method and the second calculation method of the similarity in phase by the calculation unit 15 are described in detail.

(First Calculation Method of Similarity in Phase)

Figure 3A:
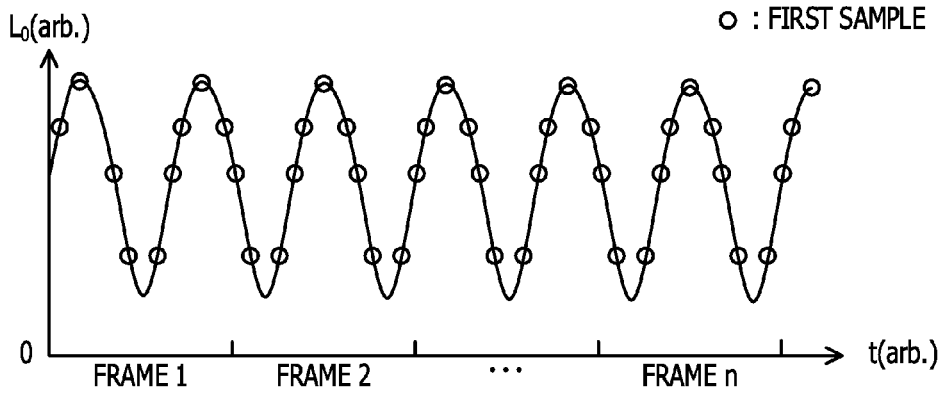
FIG. 3A is a conceptual diagram of a plurality of first samples contained in a first channel signal.
Figure 3B:
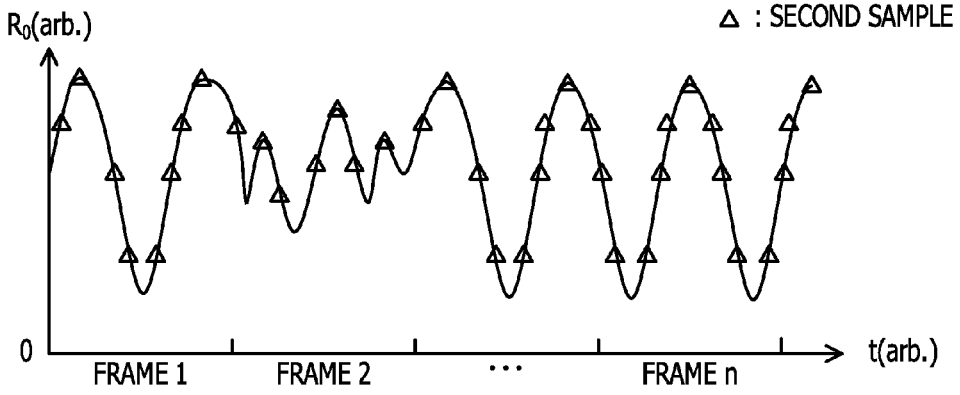
FIG. 3B is a conceptual diagram of a plurality of second samples contained in a second channel signal.
Figure 3C:
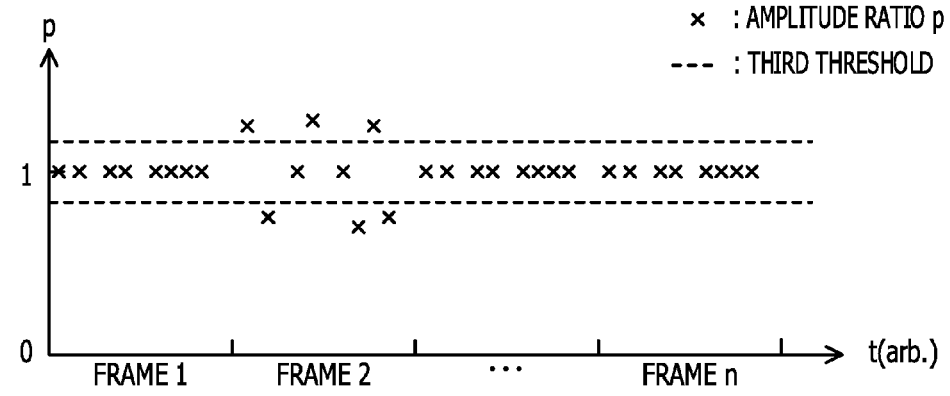
FIG. 3C is a conceptual diagram of amplitude ratios of the first sample and the second sample.

The calculation unit 15 calculates a similarity in phase based on an amplitude ratio between a plurality of first samples contained in a first channel signal and a plurality of second samples contained in a second channel signal. Specifically, the calculation unit 15 determines the similarity in phase, for example, based on an amplitude ratio between a plurality of first samples contained in the left frequency signal $L_0(k,n)$ as an example of the first channel signal and a plurality of second samples contained in the right frequency signal $R_0(k,n)$ as an example of the second channel signal. Technical significance of the similarity in phase is described later. FIG. 3A is a conceptual diagram of a plurality of first samples contained in the first channel signal. FIG. 3B is a conceptual diagram of a plurality of second samples contained in the second channel signal. FIG. 3C is a conceptual diagram of an amplitude ratio between the first sample and the second sample.

FIG. 3A illustrates an amplitude relative to a given time of the left frequency signal $L_0(k,n)$ as an example of the first channel signal, in which the left frequency signal $L_0(k,n)$ contains a plurality of first samples. FIG. 3B illustrates an amplitude relative to a given time of the right frequency signal $R_0(k,n)$ as an example of the second channel signal, in which the right frequency signal $R_0(k,n)$ contains a plurality of second samples. The calculation unit 15 calculates, for example, an amplitude ratio p between the first sample and the second sample at a given time t which is a same time within a predetermined time range, according to the following equation.

$$p = l_{0t}/r_{0t} \quad \text{(Equation 12)}$$

In Equation 12, $l_{0t}$ represents amplitude of the first sample at time t, and $r_{0t}$ represents amplitude of the second sample at the time t.

Here, technical significance of the similarity in phase is described. In FIG. 3C, an amplitude ratio between the first sample and the second sample relative to the time t calculated by the calculation unit 15 is illustrated. The selection unit 16 described later determines, for example, whether the amplitude ratio p of respective samples contained in a frame on the frame by frame basis at time t is less than a predetermined threshold (which may be called a third threshold). For example, if amplitude ratios p of all samples (or amplitude ratio p of any fixed number of samples) are less than a predetermined third threshold (for example, the third threshold may be 0.095 or more and less than 1.05), phases of the first channel signal and the second channel signal may be considered to be the same. In other words, when amplitude ratios p of all samples (or amplitude ratios of any fixed number of samples) are less than a predetermined third threshold, amplitudes of the first channel signal and the second channel signal are equal to each other. When phases of the first channel signal and the second channel signal are different from each other, amplitudes may different in many cases generally. Therefore, a substantial phase difference (similarity in phase) between the first channel signal and the second channel signal may be calculated by using the amplitude ratio p and the third threshold. Further by considering amplitude ratios p of all samples (or, amplitude ratios of any fixed number), an effect that a sample has a same amplitude ratio accidentally even when the phase is different can be excluded. For example, in the frame 2 illustrated in FIG. 3C, when amplitude ratios of all samples (or, amplitude ratios of samples of any fixed number) are equal to or more than the third threshold, phases of the first channel signal and the second channel signal may be considered not to be the same. Further, for example, amplitude ratios of all samples p in respective frames or amplitude ratios of samples of any fixed number p may be referred to as a similarity in phase. The calculation unit 15 outputs the similarity in phase to the selection unit 16.

(Second Calculation Method of Similarity in Phase)

The calculation unit 15 receives the number of predictive coefficients $c_l$ (k) and $c_2(k)$ with which the error d(k,n) becomes minimum (or, less than any predetermined second threshold), from the predictive encoding unit 13. When there are three or more sets of predictive coefficients $c_l$ (k) and $c_2(k)$ with which the error d(k,n) becomes minimum (or, less than any fixed number of the second threshold), the left frequency signal $L_0(k,n)$ as an example of the first channel signal and the right frequency signal $R_0(k,n)$ as an example of the second channel signal may be considered to have a same phase in view of the nature of the vector computation expressed by Equation 10. When there is one or two sets of predictive coefficients $c_l$ (k) and $c_2(k)$ with which the error d(k,n) becomes minimum (or, less than any fixed number of the second threshold), the left frequency signal $L_0(k,n)$ as an example of the first channel signal and the right frequency signal $R_0(k,n)$ as an example of the second channel signal may be considered not to have a same phase. The number of sets of predictive coefficients $c_l$ (k) and $c_2(k)$ with which the error d(k,n) becomes minimum (or, less than any fixed number of the second threshold) may be referred to as the similarity in phase. Since the second calculation method of the similarity in phase uses computation results of the predictive encoding unit 13 based on Equation 10, the second calculation method can reduce computation load for computing the amplitude ratio p of samples and so on, in comparison with the first computation method. The calculation unit 15 outputs the similarity in phase to the selection unit 16.

The selection unit 16 illustrated in FIG. 1 receives the stereo frequency signal from the second downmix unit 14. The selection unit 16 also receives the similarity in phase from the calculation unit 15. The selection unit 16 selects, based on the similarity in phase, a first output that outputs either one of the first channel signal (for example, the left frequency signal $L_0(k,n)$) and the second channel signal (for example, the right frequency signal $R_0(k,n)$), or a second output that outputs both (the stereo frequency signal) of the first channel signal and the second channel signal. The selection unit 16 selects the first output when the similarity in phase is equal to or more than a predetermined first threshold, and selects the second output when the similarity in phase is less than the first threshold.

For example, when the calculation unit 15 calculates the similarity in phase based on the above first calculation method, the selection unit 16 can define the first threshold with the number of predictive coefficients with which amplitude ratios p of all samples in each frame or amplitude ratios p of any number of samples satisfy the above third threshold. In this case, the first threshold may be assumed, for example, to be 90%. Also, for example, when the calculation unit 15 calculates the similarity in phase based on the above second calculation method, the selection unit 16 can define the first threshold by using the number of sets of predictive coefficients $c_1$ (k) and $c_2$(k) with which error d(k,n) becomes minimum (or less than any predetermined second threshold). In this case, three sets of the first threshold (with six $c_1$ (k) and $c_2$(k)) may be defined, for example.

When selecting the first output, the selection unit 16 calculates spatial information of the first channel signal and the second channel signal, and outputs the spatial information to the spatial information encoding unit 21. The spatial information may be, for example, a signal ratio between the first channel signal and the second channel signal. Specifically, the calculation unit 15 calculates an amplitude ratio p (which may be referred to as a signal ratio p) between the left frequency signal L.sub.0(k,n) and the right frequency signal R.sub.0(k,n) by using Equation 12 as spatial information. When the calculation unit 15 calculates the similarity in phase by using the above first calculation method, the selection unit 16 may receive the amplitude ratio p from the calculation unit 15 and output the amplitude ratio p to the spatial information encoding unit 21 as spatial information. Further, the selection unit 16 may output an average value pave of amplitude ratios of all samples in respective frames to the spatial information encoding unit 21 as spatial information.

The channel signal encoding unit 17 encodes a frequency signal(s) received from the selection unit 16 (a frequency signal of either one of the left frequency signal $L_0$(k,n) and the right frequency signal $R_0$(k,n), or a stereo frequency signal of both of the left and right frequency signals). The channel signal encoding unit 17 includes a SBR encoding unit 18, a frequency-time transformation unit 19, and an MC encoding unit 20.

Every time receiving a frequency signal, the SBR encoding unit 18 encodes a high-region component, which is a component contained in a high frequency band, out of the frequency signal on the channel by channel basis according to the SBR coding method. Thus, the SBR encoding unit 18 generates the SBR code. For example, the SBR encoding unit 18 replicates a low-region component of frequency signals of the respective channels having a strong correlation with a high-region component subjected to the SBR coding, as disclosed in Japanese Laid-open Patent Publication No. 2008-224902. The low-region component is a component of a frequency signal of the respective channels contained in a low frequency band lower than a high frequency band in which a high-region component to be encoded by the SBR encoding unit 18 is contained. The low-region component is encoded by the MC encoding unit 20 described later. Then, the SBR encoding unit 18 adjusts power of the replicated high-region component so as to match with power of the original high-region component. If it is not able to approximate a component in the original high-region component to a high-region component due to a significant difference from a low-region component even after replicating the low-region component, the SBR encoding unit 18 processes the component as auxiliary information. Then, the SBR encoding unit 18 encodes information representing a position relationship between a low-region component used for the replication and a high-region component, a power adjustment amount, and auxiliary information by quantizing. The SBR encoding unit 18 outputs a SBR code representing above encoded information to the multiplexing unit 22.

Every time receiving a frequency signal, the frequency-time transformation unit 19 transforms the frequency signal of each channel to a time domain signal or a stereo signal. For example, when the time-frequency transformation unit 11 uses the QMF filter bank, the frequency-time transformation unit 19 performs frequency-time transformation of frequency signals of the respective channels by using a complex QMF filter bank indicated in the following equation.

$$IQMF(k,n) = \frac{1}{64}\exp\left(j\frac{\pi}{128}(k+0.5)(2n-255)\right), \quad 0 \le k < 64,\ 0 \le n < 128 \qquad \text{(Equation 13)}$$

Here, IQMF(k,n) is a complex QMF using the time "n" and the frequency "k" as variables. When the time-frequency transformation unit 11 uses another time-frequency transformation processing such as fast Fourier transform, discrete cosine transform, and modified discrete cosine transform, the frequency-time transformation unit 19 uses inverse transformation of the time-frequency transformation processing. The frequency-time transformation unit 19 outputs a stereo signal of the respective channels obtained by frequency-time transformation of the frequency signal of the respective channels to the MC encoding unit 20.

Every time receiving a signal or a stereo signal of the respective channels, the MC encoding unit 20 generates an MC code by encoding a low-region component of respective channel signals according to the MC coding method. Here, the MC encoding unit 20 may utilize a technology disclosed, for example, in Japanese Laid-open Patent Publication No. 2007-183528. Specifically, the MC encoding unit 20 generates frequency signals again by performing the discrete cosine transform of the received stereo signals of the respective channels. Then, the MC encoding unit 20 calculates perceptual entropy (PE) from the re-generated frequency signal. The PE represents the amount of information for quantizing the block so that the listener (user) does not perceive noise.

The above PE is characterized in that it becomes greater with respect to a sound having a signal level varying sharply in a short time, such as, for example, an attack sound like a sound produced with a percussion instrument. Thus, the MC encoding unit 20 reduces the window length for a block having a relatively high PE value, and increases the window length for a block having a relatively low PE value. For example, the short window length contains 256 samples, and the long window length contains 2,048 samples. The MC encoding unit 20 performs the modified discrete cosine transform (MDCT) of signals or stereo signals of the respective channels by using a window having a predetermined length to transform the signals or stereo signals to a set of MDCT coefficients. Then, the MC encoding unit 20 quantizes the set of MDCT coefficients and performs variable-length coding of the set of quantized MDCT coefficients. The MC encoding unit 20 outputs the set of MDCT coefficients subjected to the variable-length coding and relevant information such as quantization coefficients to the multiplexing unit 22, as the MC code.

The spatial information encoding unit 21 generates a MPEG Surround code (hereinafter, referred to as a MPS code) from spatial information received from the first downmix unit 12, predictive coefficient codes received from the predictive encoding unit 13, and spatial information received from the calculation unit 15.

The spatial information encoding unit 21 refers to the quantization table illustrating a correspondence relationship between the similarity value and the index value in spatial information. Then, the spatial information encoding unit 21 determines an index value most close to each similarity $ICC_i(k)(i=L,R,0)$ for respective frequency bands by referring to the quantization table. The quantization table may be stored in advance in an unillustrated memory in the spatial information encoding unit 21, and so on.

FIG. 4 is a diagram illustrating an example of a quantization table relative to a similarity. In a quantization table 400 illustrated in FIG. 4, each field in the upper row 410 represents an index value, and each field in the lower row 420 represents a representative value of the similarity corresponding to an index value in the same column. An acceptable value of the similarity is in the range between −0.99 and +1. For example, when the similarity relative to the frequency band k is 0.6, a representative value of a similarity corresponding to the index value 3 is most close to the similarity relative to the frequency band k in the quantization table 400. Thus, the spatial information encoding unit 21 sets the index value relative to the frequency band k to 3.

Next, the spatial information encoding unit 21 determines a differential value between indexes in the frequency direction for frequency bands. For example, when an index value relative to a frequency band k is 3 and an index value relative to a frequency band (k−1) is 0, the spatial information encoding unit 21 determines that the differential value of the index relative to the frequency band k is 3.

The spatial information encoding unit 21 refers to a coding table illustrating a correspondence relationship between the differential value of indexes and the similarity code. Then, the spatial information encoding unit 21 determines the similarity code $idxicc_i(k)(i=L,R,0)$ of the similarity $ICC_i(k)(i=L,R,0)$ relative to the differential value between indexes for frequencies by referring to the coding table. The coding table is stored in advance in a memory in the spatial information encoding unit 21, and so on. The similarity code can be a variable length code having a shorter code length for a differential value of higher appearance frequency, such as, for example, the Huffman coding or the arithmetic coding.

FIG. 5 is an example of a diagram illustrating the relationship between an index differential value and similarity code. In the example illustrated in FIG. 5, the similarity code is the Huffman coding. In a coding table 500 illustrated in FIG. 5, each field in the left row represents an index differential value, and each field in the right row represents a similarity code associated with an index differential value in a same column. For example, when an index differential value relative to a similarity $ICC_L(k)$ of a frequency band k is 3, the spatial information encoding unit 21 sets the similarity code $idxicc_L(k)$ relative to the similarity $ICC_L(k)$ of the frequency band k to "111110" by referring to the coding table 500.

The spatial information encoding unit 21 refers to a quantization table illustrating a correspondence relationship between the intensity differential value and the index value. Then, the spatial information encoding unit 21 determines an index value most close to the intensity difference $CLD_j(k)(j=L,R,C,1,2)$ for respective frequency bands by referring to the quantization table. The spatial information encoding unit 21 determines a differential value between indexes in the frequency direction for frequency bands. For example, when an index value relative to a frequency band k is 2 and an index value relative to a frequency band (k−1) is 4, the spatial information encoding unit 21 determines that the differential value of the index relative to the frequency band k is −2.

The spatial information encoding unit 21 refers to a coding table illustrating a correspondence relationship between the index-to-index differential value and the intensity code. Then, the spatial information encoding unit 21 determines the intensity difference code $idxcld_j(k)(j=L,R,C,1,2)$ relative to the differential value of the intensity difference $CLD_j(k)$ for frequency bands k by referring to the coding table. The intensity difference code can be a variable length code having a shorter code length for a differential value of higher appearance frequency, such as, for example, the Huffman coding or the arithmetic coding. The quantization table and the coding table may be stored in advance in a memory in the spatial information encoding unit 21.

FIG. 6 is a diagram illustrating an example of a quantization table relative to an intensity difference. In a quantization table 600 illustrated in FIG. 6, each field in rows 610, 630 and 650 represents an index value, and each field in rows 620, 640 and 660 represents a representative value of the intensity difference corresponding to an index value indicated in each field in rows 610, 630 and 650 of a same column. For example, when the intensity difference $CLD_L(k)$ relative to the frequency band k is 10.8 dB, a representative value of an intensity difference corresponding to the index value 5 is most close to $CLD_L(k)$ in the quantization table 600. Thus, the spatial information encoding unit 21 sets the index value relative to $CLD_{L(k)}$ to 5.

The spatial information encoding unit 21 generates the MPS code by using the similarity code $idxicc_i(k)$, the intensity difference code $idxcld_j(k)$, and the predictive coefficient code $idxc_m(k)$. For example, the spatial information encoding unit 21 generates the MPS code by arranging the similarity code $idxicc_i(k)$, the intensity difference code $idxcld_j(k)$, and the predictive coefficient code $idxc_m(k)$ in a predetermined sequence. The predetermined sequence is described, for example, in ISO/IEC23003-1:2007. The spatial information encoding unit 21 generates the MPS code by also arranging spatial information (amplitude ratio p) received from the selection unit 16. The spatial information encoding unit 21 outputs the generated MPS code to the multiplexing unit 22.

Figure 7:
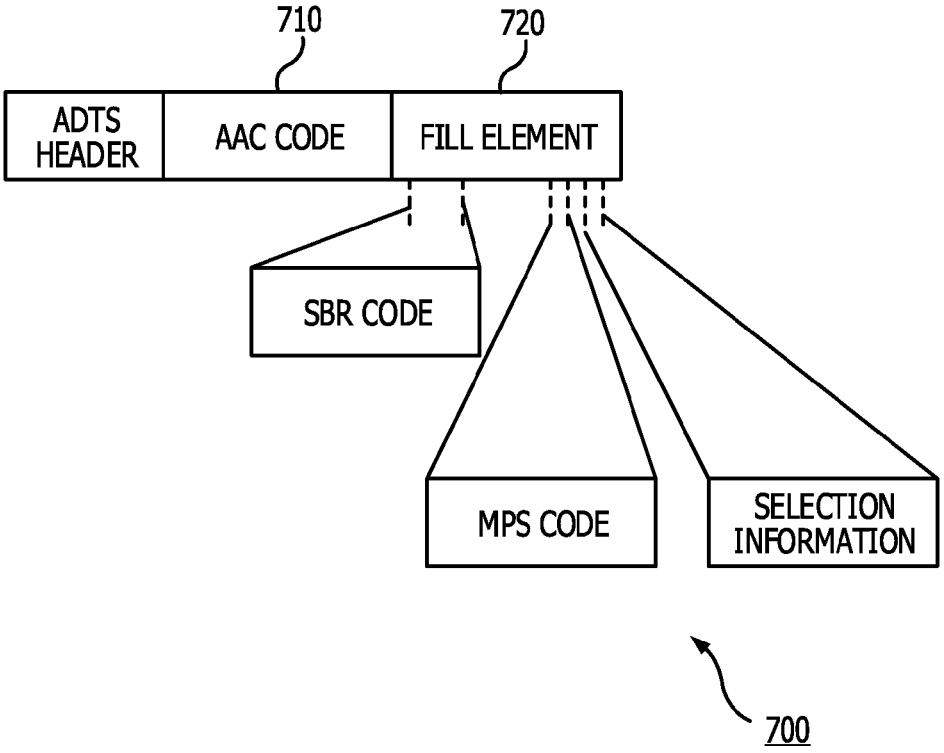
FIG. 7 is a diagram illustrating an example of a data format in which an encoded audio signal is stored.

The multiplexing unit 22 multiplexes the MC code, the SBR code, and the MPS code by arranging in a predetermined sequence. Then, the multiplexing unit 22 outputs an encoded audio signal generated by multiplexing. FIG. 7 is a diagram illustrating an example of a data format in which an encoded audio signal is stored. In the example illustrated in FIG. 7, the encoded audio signal is created in accordance with the MPEG-4 Audio Data Transport Stream (ADTS) format. In the encoded data string 700 illustrated in FIG. 7, the MC code is stored in the data block 710. The SBR code and the MPS code are stored in a partial area of the block 720 in which a FILL element of the ADTS format is stored. The multiplexing unit 22 may store selection information indicating which output the selection unit 16 selects, the first output or the second output, in a partial portion of the block 720.

Figure 8:
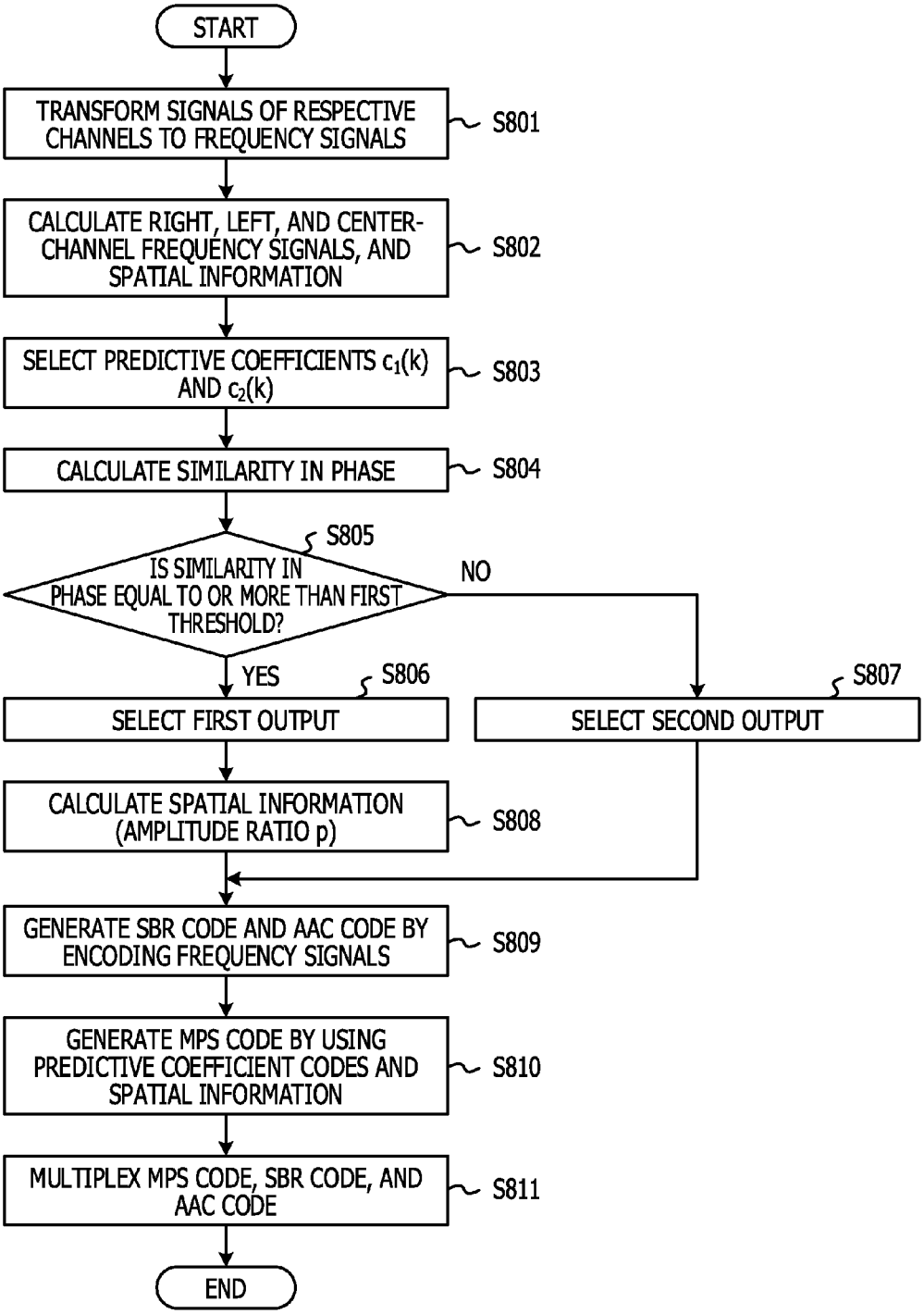
FIG. 8 is an operation flow chart of audio coding processing.

FIG. 8 is an operation flow chart of audio coding. The flow chart illustrated in FIG. 8 represents processing to the multi-channel audio signal corresponding to one frame. The audio encoding device 1 repeatedly implements audio coding steps illustrated in FIG. 8 on the frame by frame basis while the multi-channel audio signal is being received.

The time-frequency transformation unit 11 transforms signals of the respective channels to frequency signals (step S801). The time-frequency transformation unit 11 outputs time frequency signals of the respective channels to the first downmix unit 12.

Then, the first downmix unit 12 generates the left-channel frequency $L_0(k,n)$, the right frequency signal $R_0(k,n)$, and the central frequency signal $C_0(k,n)$ by downmixing frequency signals of the respective channels. Further, the first downmix unit 12 calculates spatial information of right, left and center channels (step S802). The first downmix unit 12 outputs frequency signals of the three channels to the predictive encoding unit 13 and the second downmix unit 14.

The predictive encoding unit 13 receives frequency signals of the three channels including the left frequency signal $L_0(k,n)$, the right frequency signal $R_0(k,n)$, and the central frequency signal $C_0(k,n)$ from the first downmix unit 12. The predictive encoding unit 13 selects, from the codebook, predictive coefficients $c_1(k)$ and $c_2(k)$ with which the error d(k,n) between the downmixed two channel frequency signals, that is a frequency signal prior to predictive coding and a frequency signal after predictive coding, becomes minimum, by using Equation 10 (step S803). The predictive encoding unit 13 outputs a predictive coefficient code $idxc_m(k)(m=1,2)$ corresponding to the predictive coefficients $c_1(k)$ and $c_2(k)$ to the spatial information encoding unit 21. The predictive encoding unit 13 also outputs the number of sets of predictive coefficients $c_1(k)$ and $c_2(k)$ to the calculation unit 15, as appropriate.

The calculation unit 15 receives the left frequency signal $L_0(k,n)$ and the right frequency signal $R_0(k,n)$ from the first downmix unit 12. The calculation unit 15 also receives the number of sets of predictive coefficients $c_1(k)$ and $c_2(k)$ with which the error d(k,n) becomes minimum (or, less than any predetermined second threshold), from the predictive encoding unit 13, as appropriate. The calculation unit 15 calculates the similarity in phase by using the first calculation method or the second calculation method described above (step S804). The calculation unit 15 outputs the similarity in phase to the selection unit 16.

The selection unit 16 receives the stereo frequency signal from the second downmix unit 14. The selection unit 16 also receives the similarity in phase from the calculation unit 15. The selection unit 16 selects, based on the similarity in phase, a first output that outputs either one of the first channel signal (for example, the left frequency signal $L_0(k,n)$) and the second channel signal (for example, the right frequency signal $R_0(k,n,)$), or a second output that outputs both (the stereo frequency signal) of the first channel signal and the second channel signal (step S805). When the similarity in phase is equal to or more than a predetermined first threshold (step S805—Yes), the selection unit 16 selects the first output (step S806). When the similarity in phase is less than the first threshold (step S805—No), the selection unit selects the second output (step S807).

When selecting the first output, the selection unit 16 calculates spatial information of the first channel signal and the second channel signal, and outputs the spatial information to the spatial information encoding unit 21 (step S808). The spatial information may be, for example, an amplitude ratio between the first channel signal and the second channel signal. Specifically, the calculation unit 15 calculates an amplitude ratio p (which may be referred to as a signal ratio p) between the left frequency signal L.sub.0(k,n) and the right frequency signal R.sub.0(k,n) by using Equation 12 as spatial information.

The channel signal encoding unit 17 encodes a frequency signal(s) received from the selection unit 16 (a frequency signal of either one of the left frequency signal $L_0(k,n)$ and the right frequency signal $R_0(k,n)$, or a stereo frequency signal of both of the left and right frequency signals). For example, the channel signal encoding unit 17 performs SBR encoding of a high-region component in a frequency signal of respective received channels. Also, the channel signal encoding unit 17 performs AAC encoding of a low-region component not subjected to SBR encoding in a frequency signal of respective received channels (step S809). Then, the channel signal encoding unit 17 outputs a SBR code and an MC code of information representing a positional relation between the low-region component used for replication and the corresponding high-region component, to the multiplexing unit 22.

The spatial information encoding unit 21 generates a MPS code from spatial information for encoding received from the first downmix unit 12, predictive coefficient codes received from the predictive encoding unit 13, and spatial information received from the calculation unit 15 (step S810). The spatial information encoding unit 21 outputs the generated MPS code to the multiplexing unit 22.

Finally, the multiplexing unit 22 generates an encoded audio signal by multiplexing the generated SBR code, MC code, and MPS code (step S811). The multiplexing unit 22 outputs the encoded audio signal. Now, the audio encoding device 1 ends the coding processing. In step S811, the multiplexing unit 22 may multiplex selection information indicating which output the selection unit 16 selects, the first output or the second output.

The audio encoding device 1 may execute processing of step S809 and processing of step S810 in parallel. Alternatively, the audio encoding device 1 may execute processing of step S810 before executing processing of step S809.

Figure 9A:
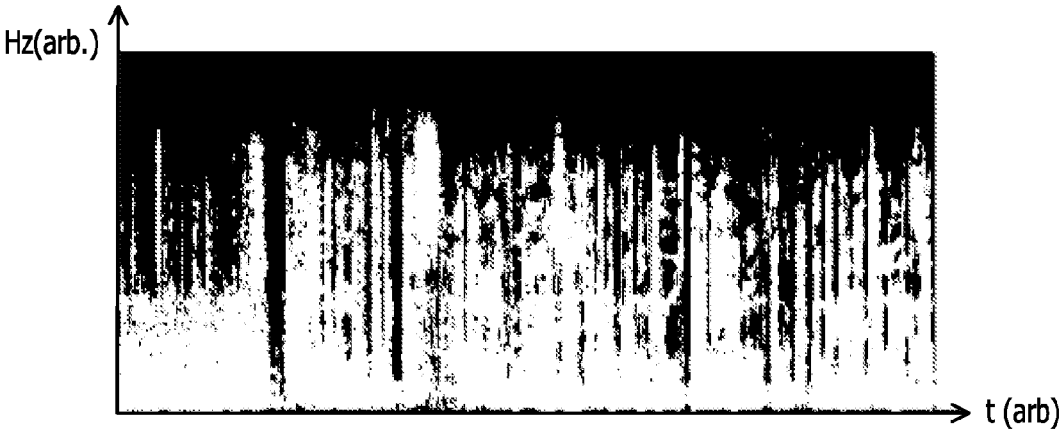
FIG. 9A is a spectrum diagram of an original sound of the multi-channel audio signal.
Figure 9B:
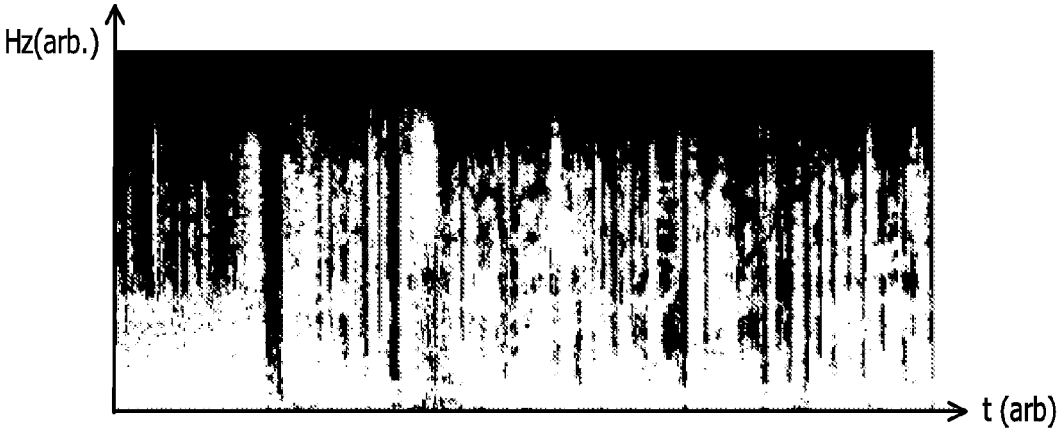
FIG. 9B is a spectrum diagram of a decoded audio signal subjected to a coding according to Embodiment 1.

FIG. 9A is a spectrum diagram of an original sound of a multi-channel audio signal. FIG. 9B is a spectrum diagram of an audio signal decoded by applying a coding of Embodiment 1. In spectrum diagrams of FIGS. 9A and 9B, the vertical axis represents the frequency, and the horizontal axis represents the sampling time. As can be understood by comparing FIGS. 9A and 9B to each other, reproduction (decoding) of an audio signal approximately similar with a spectrum of the original sound was verified when encoding is performed by applying Embodiment 1.

FIG. 10 is a diagram illustrating the coding efficiency when an audio coding according to Embodiment 1 is applied. In FIG. 10, sound sources No. 1 and No. 2 are sound sources respectively extracted from different movies. In FIG. 10, sound sources No. 1 and No. 2 are sound sources extracted from movies respectively. Sound sources No. 3 and No. 4 are sound sources respectively extracted from different music. All of the sound sources are MPEG surround of 5.1 channels with the sample frequency of 48 kHz and the time length of 60 sec. A first output ratio is a percentage of time of the first output divided by time of the second output. The reduction encoding amount is a reduction amount relative to an encoding amount when encoding is performed by selecting all of second outputs. Reduction of the encoding amount was verified in all of the sound sources. In sound sources No. 1 to No. 4, a mean value of the first output ratio was 51.3%, and a mean value of the reduction encoding amount was 23.3%. As described above, the audio encoding device according to Embodiment 1 is capable of improving the coding efficiency without degrading the sound quality.

(Embodiment 2)

Figure 11:
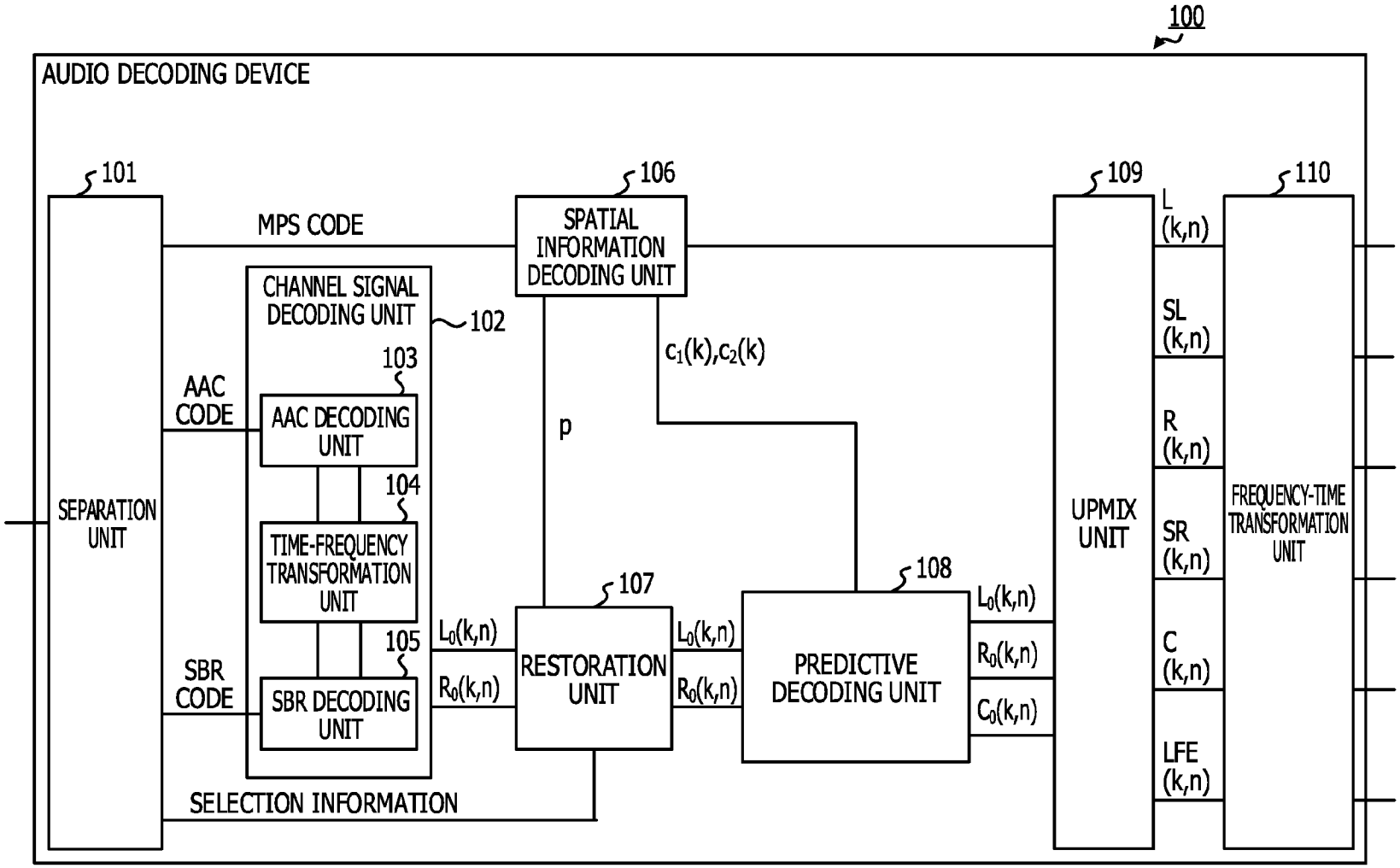
FIG. 11 is a functional block diagram of an audio decoding device according to one embodiment.

FIG. 11 is a functional block diagram of an audio decoding device 100 according to one embodiment. As illustrated in FIG. 11, the audio decoding device 100 includes a separation unit 101, a channel signal decoding unit 102, a spatial information decoding unit 106, a restoration unit 107, a predictive decoding unit 108, an upmix unit 109, and a frequency-time transformation unit 110. The channel signal decoding unit 102 includes an MC decoding unit 103, a time-frequency transformation unit 104, and a SBR decoding unit 105.

Those components included in the audio decoding device 100 are formed, for example, as separate hardware circuits by wired logic. Alternatively, those components included in the audio decoding device 100 may be implemented into the audio decoding device 100 as one integrated circuit in which circuits corresponding to respective components are integrated. The integrated circuit may be an integrated circuit such as, for example, an application specific integrated circuit (ASIC) and a field programmable gate array (FPGA). Further, those components included in the audio decoding device 100 may be function modules which are achieved by a computer program implemented on a processor of the audio decoding device 100.

The separation unit 101 receives a multiplexed encoded audio signal from the outside. The separation unit 101 separates an encoded MC code contained in the encoded audio signal, the SBR code, the MPS code, and selection information. The MC code and the SBR code may be referred to as a channel coding code, and the MPS code may be referred to as an encoded spatial information. A separation method described in ISO/IEC14496-3 is available, for example. The separation unit 101 separates the separated MPS code to the spatial information decoding unit 106, the MC code to the MC decoding unit 103, the SBR code to the SBR decoding unit 105, and the selection information to the restoration unit 107.

The spatial information decoding unit 106 receives the MPS code from the separation unit 101. The spatial information decoding unit 106 decodes the similarity $ICC_i(k)$ from the MPS code by using an example of the quantization table relative to the similarity illustrated in FIG. 4, and outputs the decoded similarity to the upmix unit 109. The spatial information decoding unit 106 decodes the intensity difference $CLD_j(k)$ from the MPS code by using an example of the quantization table relative to the intensity difference illustrated in FIG. 6, and outputs the decoded intensity difference to the upmix unit 109. The spatial information decoding unit 106 decodes the predictive coefficient from the MPS code by using an example of the quantization table relative to the predictive coefficient illustrated in FIG. 2, and outputs the decoded predictive coefficient to the predictive decoding unit 108. Also, the spatial information decoding unit 106 decodes the amplitude ratio p from the MPS code, and outputs to the restoration unit 107.

The MC decoding unit 103 receives the MC code from the separation unit 101, decodes a low-region component of channel signals according to the MC decoding method, and outputs to the time-frequency transformation unit 104. The MC decoding method may be, for example, a method described in ISO/IEC13818-7.

The time-frequency transformation unit 104 transforms signals of the respective channels being time signals decoded by the MC decoding unit 103 to frequency signals by using, for example, a QMF filter bank described in ISO/IEC14496-3, and outputs to the SBR decoding unit 105. The time-frequency transformation unit 104 may perform time-frequency transformation by using a complex QMF filter bank illustrated in the below expression.

$$QMF(k, n) = \exp\left(j\frac{\pi}{128}(k + 0.5)(2n + 1)\right), \quad 0 \le k < 64,\ 0 \le n < 128 \qquad \text{(Equation 14)}$$

Here, QMF(k,n) is a complex QMF using the time "n" and the frequency "k" as variables.

The SBR decoding unit 105 decodes a high-region component of channel signals according to the SBR decoding method. The SBR decoding method may be, for example, a method described in ISO/IEC 14496-3.

The channel signal decoding unit 102 outputs the stereo frequency signal or the frequency signal of the respective channels decoded by the MC decoding unit 103 and the SBR decoding unit 105 to the restoration unit 107.

The restoration unit 107 receives the amplitude ratio p from the spatial information decoding unit 106. The restoration unit 107 also receives a frequency signal(s) (a frequency signal of either one of the left frequency signal $L_0(k,n)$ as an example of the first channel signal and the right frequency signal $R_0(k,n)$ as an example of the second channel signal, or a stereo frequency signal of both of the left and right frequency signals) from the channel signal decoding unit 102. Further, the restoration unit 107 also receives, from the separation unit 101, the selection information indicating an output selected by the selection unit 16, that is either the first output (either one of the first channel signal and the second channel signal) or the second output (both of the first channel signal and the second channel signal). The restoration unit 107 may not receive the selection information. For example, the restoration unit 107 is also capable of determining based on the number of frequency signals received from the spatial information decoding unit 106 which output the selection unit 16 selects, the first output or the second output.

When the selection unit 16 selects the second output, the restoration unit 107 outputs the left frequency signal $L_0(k,n)$ as an example of the first channel signal and the right frequency signal $R_0(k,n)$ as an example of the second channel signal to the predictive decoding unit 108. In other words, the restoration unit 107 outputs the stereo frequency signal to the predictive decoding unit 108. When the selection unit 16 selects the second output and the restoration unit 107 has received, for example, the left frequency signal $L_0(k,n)$ as an example of the first channel signal, the restoration unit 107 restores the right frequency signal $R_0(k,n)$ by integrating the amplitude ratio p to the left frequency signal $L_0(k,n)$. Also, for example, when the right frequency signal $R_0(k,n)$ as an example of the second channel signal has been received, the restoration unit 107 restores the left frequency signal $L_0(k,n)$ by integrating the amplitude ratio p to the right frequency signal $R_0(k,n)$. Through such restoration processing, the restoration unit 107 outputs the left frequency signal $L_0(k,n)$ as an example of the first channel signal and the right frequency signal $R_0(k,n)$ as an example of the second channel signal to the predictive decoding unit 108. In other words, the restoration unit 107 outputs the stereo frequency signal to the predictive decoding unit 108.

The predictive decoding unit 108 performs predictive decoding of the center-channel signal $C_0(k,n)$ predictively encoded from a predictive coefficient received from the spatial information decoding unit 106 and a stereo frequency signal received from the restoration unit 107. For example, the predictive decoding unit 108 is capable of predictively decoding the center-channel signal $C_0(k,n)$ from a stereo frequency signal and predictive coefficients $c_1(k)$ and $c_2(k)$ of the left frequency signal $L_0(k,n)$ and right frequency signal $R_0(k,n)$ according to the following equation.

$$C_0(k,n)=c_1(k)\cdot L_0(k,n)+c_2(k)\cdot R_0(k,n) \quad \text{(Equation 15)}$$

The predictive decoding unit 108 outputs the left frequency signal $L_0(k,n)$, the right frequency signal $R_0(k,n)$, and the central frequency signal $C_0(k,n)$ to the upmix unit 109.

The upmix unit 109 performs matrix transformation according to the following equation for the left frequency signal $L_0(k,n)$, the right frequency signal $R_0(k,n)$, and the central frequency signal $C_0(k,n)$, received from the predictive decoding unit 108.

$$\begin{pmatrix} L_{out}(k,n) \\ R_{out}(k,n) \\ C_{out}(k,n) \end{pmatrix} = \frac{1}{3}\begin{pmatrix} 2 & -1 & 1 \\ -1 & 2 & 1 \\ \sqrt{2} & \sqrt{2} & -\sqrt{2} \end{pmatrix}\begin{pmatrix} L_0(k,n) \\ R_0(k,n) \\ C_0(k,n) \end{pmatrix} \quad \text{(Equation 16)}$$

Here, $L_{OUT}(k,n)$, $R_{OUT}(k,n)'$ and $C_{OUT}(k,n)$ are respectively left-channel frequency signal, right-channel frequency, and center-channel frequency. The upmix unit 109 upmixes, for example, to a 5.1 channel audio signal, the matrix-transformed left-channel frequency signal $L_{OUT}(k,n)$, right-channel frequency signal $R_{OUT}(k,n)$, center-channel frequency signal $C_{OUT}(k,n)$, and spatial information received from the spatial information decoding unit 106. Upmixing may be performed by using, for example, a method described in ISO/IEC23003-1.

The frequency-time transformation unit 110 performs frequency-to-time transformation of signals received from the upmix unit 109 by using a QMF filter bank indicated in the following equation.

$$IQMF(k,n) = \frac{1}{64}\exp\left(j\frac{\pi}{64}\left(k+\frac{1}{2}\right)(2n-127)\right), \quad \text{(Equation 17)}$$

$$0 \le k < 32,\ 0 \le n < 32$$

In such a manner, the audio decoding device disclosed in Embodiment 2 is capable of accurately decoding a predictively encoded audio signal with the coding efficiency improved without degrading the sound quality.

(Embodiment 3)

Figure 12:
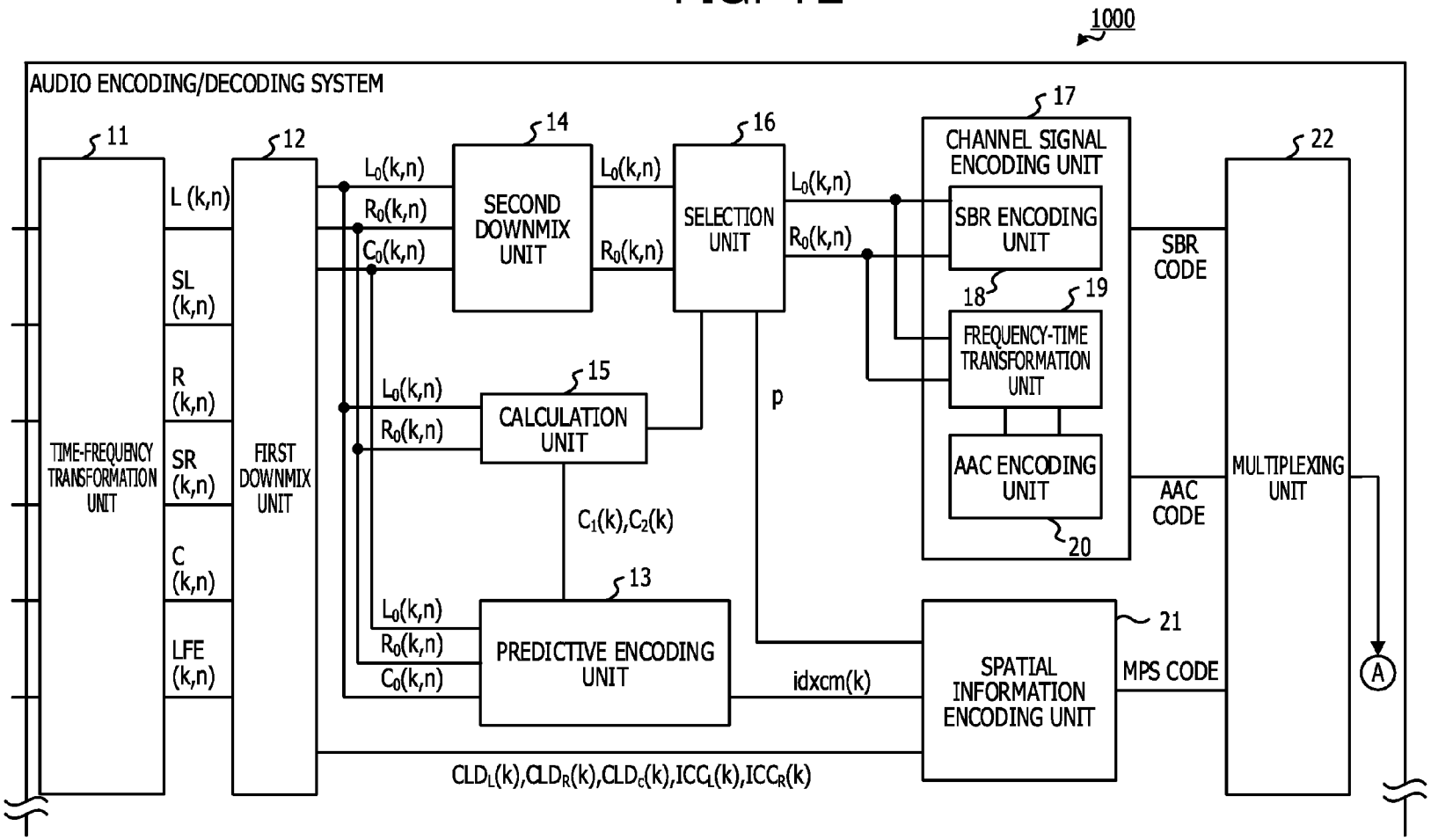
FIG. 12 is a functional block diagram (Part 1) of an audio encoding/decoding system according to one embodiment.
Figure 13:
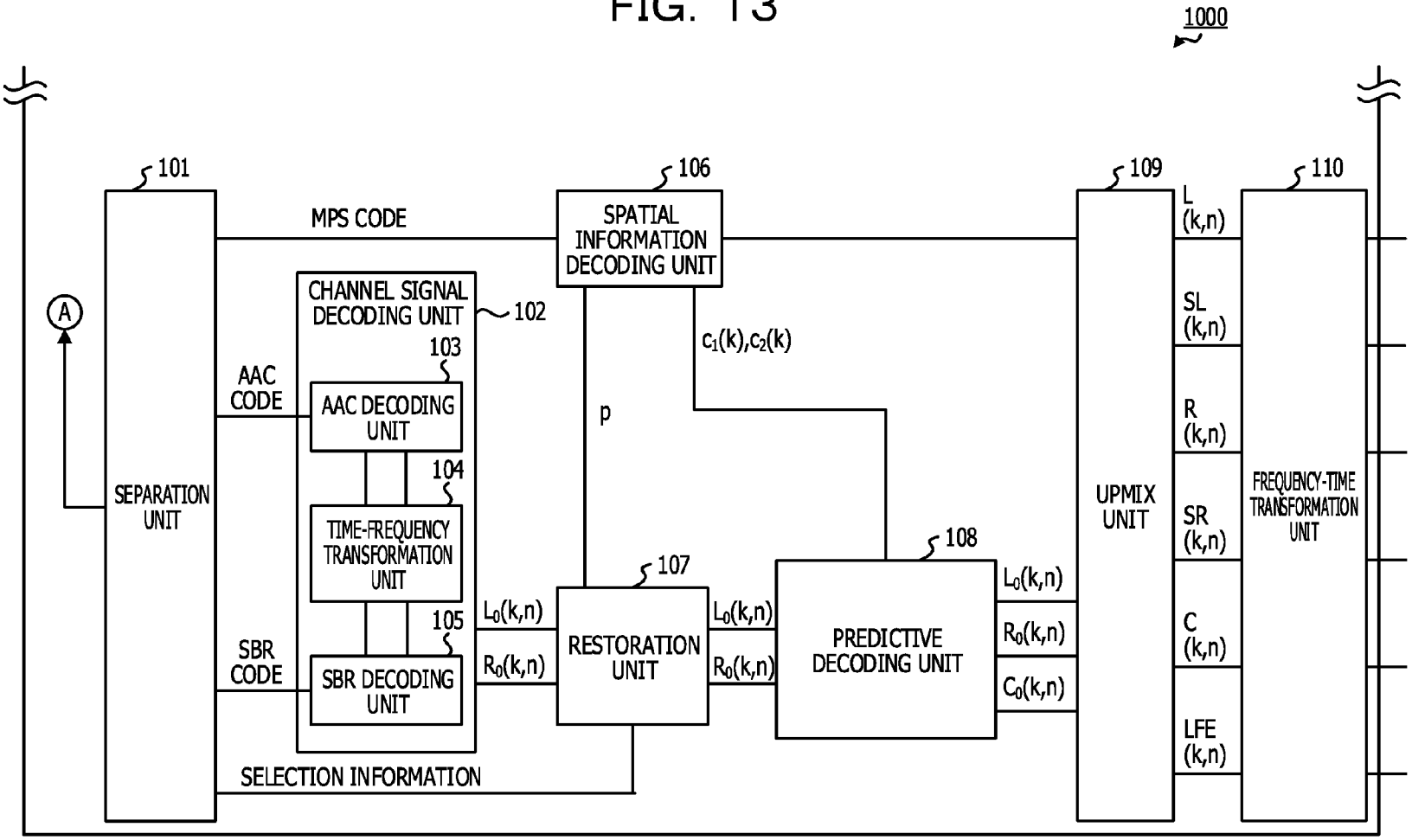
FIG. 13 is a functional block diagram (Part 2) of an audio encoding/decoding system according to one embodiment.

FIG. 12 is a functional block diagram (Part 1) of an audio encoding/decoding system 1000 according to one embodiment. FIG. 13 is a functional block diagram (Part 2) of an audio encoding/decoding system 1000 according to one embodiment. As illustrated in FIGS. 12 and 13, the audio encoding/decoding system 1000 includes a time-frequency transformation unit 11, a first downmix unit 12, a predictive encoding unit 13, a second downmix unit 14, a calculation unit 15, a selection unit 16, a channel signal encoding unit 17, a spatial information encoding unit 21, and a multiplexing unit 22. Further, the channel signal encoding unit 17 includes a SBR (Spectral Brand Replication) encoding unit 18, a frequency-time transformation unit 19, and an MC (Advanced Audio Coding) encoding unit 20. Also, the audio encoding/decoding system 1000 includes a separation unit 101, a channel signal decoding unit 102, a spatial information decoding unit 106, a restoration unit 107, a predictive decoding unit 108, an upmix unit 109, and a frequency-time transformation unit 110. The channel signal decoding unit 102 includes an MC decoding unit 103, a time-frequency transformation unit 104, and a SBR decoding unit 105. Detailed description of functions of the audio encoding/decoding system 1000 is omitted since the functions are same as those illustrated in FIGS. 1 and 11.

(Embodiment 4)

The multi-channel audio signal is digitized with very high sound quality unlike an analog method. On the other hand, such digitized data is characterized in that the data can be easily replicated in a complete format. Accordingly, additional information of copyright information may be embedded in a multi-channel audio signal in a format not perceivable by the user. For example, in the audio encoding device 1 according to Embodiment 1 illustrated in FIG. 1, when the selection unit 16 selects the first output, the amount of encoding of either the first channel signal or the second channel signal can be reduced. By allocating a reduced amount of encoding to embedding of additional information, the embedded amount of additional information can be increased up to approximately 2,000 times the second output. The additional information may be stored, for example, in selection information of the FILL element 720 illustrated in FIG. 7. The multiplexing unit 22 illustrated in FIG. 1 may be provided with flag information indicating that additional information is added to selection information. Further, in the audio decoding device 100 according to Embodiment 2, the restoration unit 107 illustrated in FIG. 11 may detect addition of the additional information based on flag information and extract the additional information stored in the selection information.

(Embodiment 5)

Figure 14:
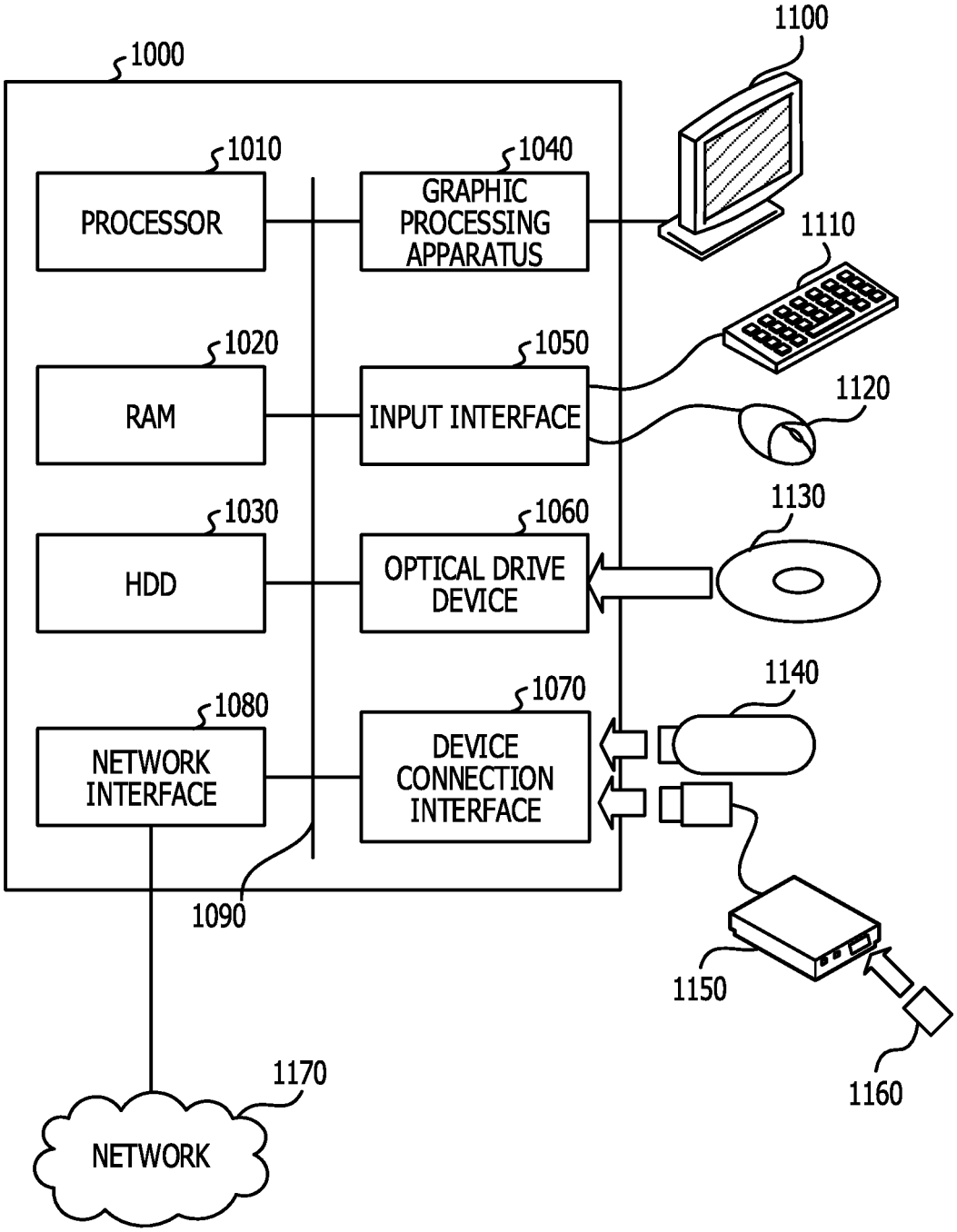
FIG. 14 is a hardware configuration diagram of a computer functioning as an audio encoding device or an audio decoding device according to one embodiment.

FIG. 14 is a hardware configuration diagram of a computer functioning as the audio encoding device 1 or the audio decoding device 100 or according to one embodiment. As illustrated in FIG. 14, the audio encoding device 1 or the audio decoding device 100 includes a computer 1001 and an input/output device (peripheral device) connected to the computer 1001.

The computer 1001 as a whole is controlled by a processor 1010. The processor 1010 is connected to a random access memory (RAM) 1020 and a plurality of peripheral devices via a bus 1090. The processor 1010 may be a multi-processor. The processor 1010 is, for example, a CPU, a micro processing unit (MPU), a digital signal processor (DSP), an application specific integrated circuit (ASIC), or a programmable logic device (PLD). Further, the processor 1010 may be a combination of two or more elements selected from CPU, MPU, DSP, ASIC and PLD. For example, the processor 1010 is capable of performing in functional blocks illustrated in FIG. 1, including the time-frequency transformation unit 11, the first downmix unit 12, the predictive encoding unit 13, the second downmix unit 14, the calculation unit 15, the selection unit 16, the channel signal encoding unit 17, the spatial information encoding unit 21, the multiplexing unit 22, the SBR encoding unit 18, the frequency-time transformation unit 19, the MC encoding unit 20, and so on. Further, the processor 1010 is capable of performing in functional blocks illustrated in FIG. 11, such as the separation unit 101, the channel signal decoding unit 102, the MC decoding unit 103, the time-frequency transformation unit 104, the SBR decoding unit 105, the spatial information decoding unit 106, the restoration unit 107, predictive decoding unit 108, upmix unit 109, the frequency-time transformation unit 110, and so on.

The RAM 1020 is used as a main storage device of the computer 1001. The RAM 1020 temporarily stores at least a portion of programs of an operating system (OS) for running the processor 1010 and an application program.

Further, the RAM 1020 stores various data to be used for processing by the processor 1010.

Peripheral devices connected to the bus 1090 include a hard disk drive (HDD) 1030, a graphic processing device 1040, an input interface 1050, an optical drive device 1060, a device connection interface 1070, and a network interface 1080.

The HDD 1030 magnetically writes and reads data from an integrated disk. For example, the HDD 1030 is used as an auxiliary storage device of the computer 1001. The HDD 1030 stores an OS program, an application program, and various data. The auxiliary storage device may include a semiconductor memory device such as a flash memory.

The graphic processing device 1040 is connected to a monitor 1100. The graphic processing device 1040 displays various images on a screen of the monitor 1100 in accordance with an instruction given by the processor 1010. A display device and a liquid crystal display device using cathode ray tube (CRT) are available as the monitor 1100.

The input interface 1050 is connected to a keyboard 1110 and a mouse 1120. The input interface 1050 transmits signals sent from the keyboard 1110 and the mouse 1120 to the processor 1010. The mouse 1120 is an example of pointing devices. Thus, another pointing device may be used. Other pointing devices include a touch panel, a tablet, a touch pad, a truck ball, and so on.

The optical drive device 1060 reads data stored in an optical disk 1130 by utilizing a laser beam. The optical disk 1130 is a portable recording medium in which data is recorded in a manner allowing readout by light reflection. The optical disk 1130 includes a digital versatile disc (DVD), a DVD-RAM, a Compact Disc Read-Only Memory (CD-ROM), a CD-Recordable (R)/ReWritable (RW), and so on. A program stored in the optical disk 1130 serving as a portable recording medium is installed in the audio encoding device or the audio decoding device 100 via the optical drive device 1060. A given program installed may be executed on the audio encoding device 1 or the audio decoding device 100.

The device connection interface 1070 is a communication interface for connecting peripheral devices to the computer 1001. For example, the device connection interface 1070 may be connected to a memory device 1140 and a memory reader writer 1150. The memory device 1140 is a recording medium having a function for communication with the device connection interface 1070. The memory reader writer 1150 is a device configured to write data into a memory card 1160 or read data from the memory card 1160. The memory card 1160 is a card type recording medium.

A network interface 1080 is connected to a network 1170. The network interface 1080 transmits and receives data from other computers or communication devices via the network 1170.

The computer 1001 implements, for example, the above mentioned graphic processing function by executing a program recorded in a computer readable recording medium. A program describing details of processing to be executed by the computer 1001 may be stored in various recording media. The above program may comprise one or more function modules. For example, the program may comprise function modules which implement processing illustrated in FIG. 1, such as the time-frequency transformation unit 11, the first downmix unit 12, the predictive encoding unit 13, the second downmix unit 14, the calculation unit 15, the selection unit 16, the channel signal encoding unit 17, the spatial information encoding unit 21, the multiplexing unit 22, the SBR encoding unit 18, the frequency-time transformation unit 19, and the MC encoding unit 20. Further, the program may comprise function modules which implement processing illustrated in FIG. 11, such as the separation unit 101, the channel signal decoding unit 102, the AAC decoding unit 103, the time-frequency transformation unit 104, the SBR decoding unit 105, the spatial information decoding unit 106, the restoration unit 107, predictive decoding unit 108, the upmix unit 109, and the frequency-time transformation unit 110. A program to be executed by the computer 1001 may be stored in the HDD 1030. The processor 1010 implements a program by loading at least a portion of a program stored in the HDD 1030 into the RAM 1020. A program to be executed by the computer 1001 may be stored in a portable recording medium such as the optical disk 1130, the memory device 1140, and the memory card 1160. A program stored in a portable recording medium becomes ready to run, for example, after being installed on the HDD 1030 by control through the processor 1010. Alternatively, the processor 1010 may run the program by directly reading from a portable recording medium.

In Embodiments described above, components of illustrated respective devices may not be physically configured as illustrated. That is, specific separation and integration of devices are not limited to those illustrated, and devices may be configured by separating and/or integrating a whole or a portion thereof on any basis depending on various loads and utilization status.

Further, according to other embodiments, channel signal coding of the audio encoding device may be performed by encoding the stereo frequency signal according to a different coding method. For example, the channel signal encoding unit may encode all of frequency signals in accordance with the MC coding method. In this case, the SBR encoding unit in the audio encoding device illustrated in FIG. 1 is omitted.

Multi-channel audio signals to be encoded or decoded are not limited to the 5.1 channel signal. For example, audio signals to be encoded or decoded may be audio signals having a plurality of channels such as 3 channels, 3.1 channels or 7.1 channels. In this case, the audio encoding device also calculates frequency signals of the respective channels by performing time-frequency transformation of audio signals of the channels. Then, the audio encoding device downmixes frequency signals of the channels to generate a frequency signal with the number of channels less than an original audio signal.

Audio coding devices according to the above embodiments may be implemented on various devices utilized for conveying or recording an audio signal, such as a computer, a video signal recorder or a video transmission apparatus.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio encoding device comprising:

at least one memory which stores a plurality of instructions; and at least one hardware processor to execute the instructions to cause the audio encoding device to execute:

generating a first channel signal and a second channel signal by downmixing channel signals in a plurality of channels of an audio signal;

calculating one of an amplitude ratio between a plurality of first signal samples in the first channel signal and a plurality of second signal samples in the second channel signal or a number of predictive coefficients with which an error in predictive coding, based on the first and second channel signals, of a third channel signal contained in the plurality of channels becomes less than a first threshold;

selecting, when the amplitude ratio is equal to or more than a second threshold or when the number of predictive coefficients is equal to or more than a third threshold, a first signal output in which one of the first channel signal and the second channel signal is output to be encoded and the other of the first channel signal and the second channel signal is not output to be encoded;

selecting, when the amplitude ratio is less than the second threshold or when the number of predictive coefficients is less than the third threshold, a second signal output in which both the first and second channel signals are output to be encoded;

encoding the one of the first channel signal and the second channel signal when selecting the first signal output; and encoding the first channel signal and the second channel signal when selecting the second signal output.

2. The device according to claim 1, wherein spatial information of the first channel signal and the second channel signal is calculated when selecting the first signal output.

3. The device according to claim 2, wherein the spatial information is the amplitude ratio.

4. The device according to claim 1, wherein additional information regarding the audio signal for the encoding in accordance with a reduced amount of encoded signal is output when selecting the first signal output.

5. An audio coding method comprising:

by at least one hardware processor that executes instructions stored in at least one memory coupled with the at least one hardware processor, generating a first channel signal and a second channel signal by downmixing channel signals in a plurality of channels of an audio signal;

calculating one of an amplitude ratio between a plurality of first signal samples in the first channel signal and a plurality of second signal samples in the second channel signal or a number of predictive coefficients with which an error in predictive coding, based on the first and second channel signals, of a third channel signal contained in the plurality of channels becomes less than a first threshold;

selecting, when the amplitude ratio is equal to or more than a second threshold or when the number of predictive coefficients is equal to or more than a third threshold, a first signal output in which one of the first channel signal and the second channel signal is output to be encoded and the other of the first channel signal and the second channel signal is not output to be encoded;

selecting, when the amplitude ratio is less than the second threshold or when the number of predictive coefficients is less than the third threshold, a second signal output in which both the first and second channel signals are output to be encoded;

encoding the one of the first channel signal and the second channel signal when selecting the first signal output; and encoding the selected one of the first signal output or the second signal output.

6. The method according to claim 5, wherein spatial information of the first channel signal and the second channel signal is calculated when selecting the first signal output.

7. The method according to claim 5, wherein the spatial information is the amplitude ratio.

8. The method according to claim 5, wherein additional information regarding the audio signal for the encoding in accordance with a reduced amount of encoded signal is output when selecting the first signal output.

9. A computer-readable non-transitory storage medium storing an audio coding program that causes a computer to execute a process comprising:

generating a first channel signal and a second channel signal by downmixing channel signals in a plurality of channels of an audio signal;

calculating one of an amplitude ratio between a plurality of first signal samples in the first channel signal and a plurality of second signal samples in the second channel signal or a number of predictive coefficients with which an error in predictive coding, based on the first and second channel signals, of a third channel signal contained in the plurality of channels becomes less than a first threshold;

selecting, when the amplitude ratio is equal to or more than a second threshold or when the number of predictive coefficients is equal to or more than a third threshold, a first signal output in which one of the first channel signal and the second channel signal is output to be encoded and the other of the first channel signal and the second channel signal is not output to be encoded;

selecting, when the amplitude ratio is less than the second threshold or when the number of predictive coefficients is less than the third threshold, a second signal output in which both the first and second channel signals are output to be encoded;

encoding the one of the first channel signal and the second channel signal when selecting the first signal output; and encoding the selected one of the first signal output or the second signal output.

10. An audio decoding device comprising:

at least one memory which stores a plurality of instructions; and at least one hardware processor to execute the instructions to cause the audio decoding device to execute:

in response to selection information indicating one of a first signal output in which one of an encoded first channel signal and an encoded second channel signal contained in a plurality of channels of an encoded audio signal and the other of the encoded first channel signal and the encoded second channel signal is not output and a second signal output in which both of the encoded first channel signal and the encoded second channel signal, restoring by decoding the encoded first channel signal and the encoded second channel signal from one of the encoded first channel signal or the encoded second channel signal and spatial information for decoding the encoded first channel signal and the encoded second channel signal, the spatial information corresponding to an amplitude ratio between a plurality of first signal samples in the encoded first channel signal and a plurality of second signal samples in the encoded second channel signal, wherein the selection information indicates the first signal output when the amplitude ratio is equal to or more than a second threshold or when a number of predictive coefficients, with which an error in predictive coding, based on the encoded first and second channel signals, of an encoded third channel signal contained in the plurality of channels becomes less than a first threshold, is equal to or more than a third threshold, and indicates the second signal output when the amplitude ratio is less than the second threshold or when the number of predictive coefficients is less than the third threshold.

* * * * *